US008800305B2

(12) United States Patent
Pape et al.

(10) Patent No.: US 8,800,305 B2
(45) Date of Patent: Aug. 12, 2014

(54) RETROFIT ICE MAKING AND BAGGING APPARATUS AND RETROFIT METHOD OF INSTALLATION ON AISLE FREEZER

(75) Inventors: Henrik Pape, Horsens (DK); Ken Strong, Oceanside, CA (US)

(73) Assignee: Schur Technology A/S, Horsens (DK)

( * ) Notice: Subject to any disclaimer, the term of this patent is extended or adjusted under 35 U.S.C. 154(b) by 875 days.

(21) Appl. No.: 12/847,898

(22) Filed: Jul. 30, 2010

(65) Prior Publication Data

US 2010/0313524 A1 Dec. 16, 2010

Related U.S. Application Data

(63) Continuation of application No. 12/580,146, filed on Oct. 15, 2009, now Pat. No. 8,122,689, which is a continuation-in-part of application No. 12/583,652, filed on Aug. 24, 2009, now Pat. No. 8,256,195, and a continuation-in-part of application No. 12/449,132, filed as application No. PCT/DK2008/000027 on Jul. 24, 2009, said application No. 12/580,146 is a continuation-in-part of application No. 12/583,655, filed on Aug. 24, 2009, now abandoned.

(30) Foreign Application Priority Data

Jan. 24, 2007 (DK) ..... 200700109
Apr. 21, 2009 (DK) ..... 200900512

(51) Int. Cl.

| | |
|---|---|
| ***B65B 63/08*** | (2006.01) |
| ***F25C 1/00*** | (2006.01) |
| ***F25D 19/00*** | (2006.01) |
| ***F25C 1/24*** | (2006.01) |

(52) U.S. Cl.

USPC ..... 62/60; 62/66; 62/298; 62/301; 53/440

(58) Field of Classification Search

USPC ..... 62/60, 66, 298, 301; 29/890.03; 53/440
See application file for complete search history.

(56) References Cited

U.S. PATENT DOCUMENTS

| | | | |
|---|---|---|---|
| 2,116,300 | A | 5/1938 | Campos |
| 2,272,530 | A | 2/1942 | Patterson |

(Continued)

FOREIGN PATENT DOCUMENTS

| | | | |
|---|---|---|---|
| CN | 2150499 | Y | 12/1993 |
| EP | 0459050 | | 12/1991 |

(Continued)

OTHER PUBLICATIONS

International Search Report from PCT/DK2008/000027, issued on Apr. 4, 2008, 5 pages.

(Continued)

*Primary Examiner* — Ljiljana Ciric
(74) *Attorney, Agent, or Firm* — Procopio, Cory, Hargreaves & Savitch LLP

(57) ABSTRACT

A retrofit ice making and bagging apparatus and retrofit installation method provide automatic supply of bags of ice into a freezer compartment. The apparatus has an outer housing with a lower end configured for securing on top of an aisle freezer so that openings in the lower end of the housing and upper end of the freezer are aligned to provide a passageway into the freezer compartment. An ice making unit and bag making and filling station are mounted in the housing. Ice is transported from the ice making station into partially formed bags at the bag making and filling station, and a bag is sealed and separated when a sufficient amount of ice is supplied to the bag. The bag making and filling station communicates with the passageway into a storage compartment in the freezer, whereby separated bags of ice fall into the storage compartment on completion.

49 Claims, 36 Drawing Sheets

(56) References Cited

U.S. PATENT DOCUMENTS 2,322,175 A 6/1943 Talbot et al.
2,334,256 A 11/1943 Eaton
2,582,381 A 1/1952 Higginbottom
2,584,726 A 2/1952 McOmber
2,649,235 A 8/1953 Edmonds
2,669,377 A 2/1954 Poolen et al.
2,777,264 A 1/1957 Schenk
2,986,897 A 6/1961 Howard
3,119,518 A 1/1964 Eschenburg et al.
3,151,668 A 10/1964 Zimmerman
3,211,338 A 10/1965 Weil et al.
3,277,666 A 10/1966 Simmons
3,323,280 A 6/1967 Rausch
3,380,222 A 4/1968 Bergmann et al.
3,416,620 A 12/1968 McClusky
3,488,910 A 1/1970 Stoger et al.
3,498,020 A 3/1970 Eppenberger
3,501,887 A 3/1970 Umholtz et al.
3,559,424 A 2/1971 Nelson
3,608,657 A 9/1971 Johnson et al.
3,608,786 A 9/1971 Shelley et al.
3,610,482 A 10/1971 Van Steenburgh
3,618,733 A 11/1971 Winsett
3,626,662 A 12/1971 Graveley
3,654,771 A 4/1972 Kuebler
3,688,471 A 9/1972 Clark
3,698,451 A 10/1972 Hudson
3,712,019 A 1/1973 Lamka
3,715,119 A 2/1973 Shelley et al.
3,719,307 A 3/1973 Larson
3,788,566 A 1/1974 Morris, Jr.
3,789,570 A 2/1974 Mullins, Jr.
3,789,574 A 2/1974 Weikert
3,807,193 A 4/1974 McKenney et al.
3,822,866 A 7/1974 Daester
3,830,266 A 8/1974 Hudson
3,897,676 A 8/1975 Membrino
3,903,674 A 9/1975 Brush et al.
3,913,343 A 10/1975 Rowland et al.
3,918,266 A 11/1975 Gindy et al.
3,969,909 A 7/1976 Barto et al.
3,974,625 A 8/1976 Simmons
3,977,851 A 8/1976 Toya
3,982,377 A 9/1976 Vanderpool
4,013,199 A 3/1977 Brown
4,027,459 A 6/1977 Nieskens et al.
4,056,215 A 11/1977 Zwahlen
4,074,507 A 2/1978 Ruf et al.
4,088,243 A 5/1978 Deveson
4,129,015 A 12/1978 Morris, Jr.
4,132,049 A 1/1979 Mullins, Jr.
4,136,803 A 1/1979 Tobias et al.
4,137,689 A 2/1979 McClusky et al.
4,139,029 A 2/1979 Geraci
4,139,126 A 2/1979 Krasner
4,158,426 A 6/1979 Frohbieter
4,189,063 A 2/1980 Matthiesen
4,252,002 A 2/1981 Mullins, Jr.
4,276,751 A 7/1981 Saltzman et al.
4,320,615 A 3/1982 Gmuer
4,348,872 A 9/1982 Hill
4,350,004 A 9/1982 Tsujimoto et al.
4,368,608 A 1/1983 Ray
4,404,817 A 9/1983 Cox
4,409,763 A 10/1983 Rydeen
4,420,197 A 12/1983 Dreiling
4,461,520 A 7/1984 Alneng
4,467,622 A 8/1984 Takahashi et al.
4,478,386 A 10/1984 Mikkelsen
4,487,093 A 12/1984 Peroutky
4,522,292 A 6/1985 Euverard
4,527,401 A 7/1985 Nelson
4,534,155 A 8/1985 Sawa et al.
4,587,810 A 5/1986 Fletcher
4,598,529 A 7/1986 Pongrass et al.
4,612,779 A 9/1986 Hatton
4,673,103 A 6/1987 Anderson et al.
4,689,937 A 9/1987 Finan, Sr. et al.
4,715,167 A 12/1987 Savigny
4,732,301 A 3/1988 Tobias
4,803,847 A 2/1989 Koeneman et al.
4,850,202 A 7/1989 Kito et al.
4,878,523 A 11/1989 Balsamico et al.
4,903,494 A 2/1990 Wigley
4,909,696 A 3/1990 Wigley
4,930,685 A 6/1990 Landers
4,942,979 A 7/1990 Linstromberg et al.
4,942,983 A 7/1990 Bradbury
4,979,353 A 12/1990 Seppala
4,981,237 A 1/1991 Landers
4,995,219 A 2/1991 Hicks
5,005,341 A 4/1991 Tetenborg
5,009,060 A 4/1991 Furukawa
5,027,610 A 7/1991 Hara
5,056,299 A 10/1991 Furukawa
5,070,798 A 12/1991 Jurgens
5,079,897 A 1/1992 Muller
5,088,300 A 2/1992 Wessa
5,108,590 A 4/1992 DiSanto
5,109,651 A 5/1992 Stuart
5,112,477 A 5/1992 Hamlin
5,211,030 A 5/1993 Jameson
5,277,016 A 1/1994 Williams et al.
RE34,533 E 2/1994 Wigley
5,440,863 A 8/1995 Toya et al.
5,473,865 A 12/1995 Tanaka et al.
5,630,310 A 5/1997 Chadwell
5,722,215 A 3/1998 Yuyama
5,791,123 A 8/1998 Bolz
5,813,196 A 9/1998 Page et al.
5,822,955 A 10/1998 Woosley et al.
5,832,700 A 11/1998 Kammler et al.
6,112,539 A 9/2000 Colberg
6,237,308 B1 5/2001 Quintin et al.
6,282,869 B1 9/2001 Bullock et al.
6,305,177 B1 10/2001 Edwards et al.
6,474,048 B1 11/2002 Metzger et al.
6,725,625 B1 4/2004 Honma et al.
6,862,866 B2 3/2005 Jacobsen et al.
6,904,765 B2 6/2005 Lee et al.
6,904,946 B2 6/2005 James
7,062,892 B2 6/2006 Metzger
7,331,163 B2 * 2/2008 Hau et al. ..... 62/331
7,421,834 B1 9/2008 Doolan
7,426,812 B2 9/2008 Metzger
7,426,945 B2 9/2008 Dalton et al.
7,669,434 B2 * 3/2010 Leclear et al. ..... 62/331
7,681,408 B2 3/2010 Hobson et al.
7,849,660 B2 12/2010 Metzger
7,958,918 B2 6/2011 Ladson
7,992,364 B2 8/2011 Thurgood et al.
8,122,689 B2 2/2012 Pape
8,299,656 B2 * 10/2012 Allard et al. ..... 307/154
8,336,975 B2 * 12/2012 Allard et al. ..... 312/405.1
8,438,870 B2 * 5/2013 Leclear et al. ..... 62/377
2003/0000180 A1 * 1/2003 Singer ..... 53/512
2004/0216481 A1 11/2004 James et al.
2005/0115210 A1 6/2005 Noumi
2006/0021300 A1 2/2006 Tada et al.
2006/0090427 A1 * 5/2006 Hau et al. ..... 62/331
2007/0175235 A1 8/2007 Metzger
2008/0047233 A1 2/2008 Metzger
2008/0110129 A1 5/2008 LeBlanc et al.
2008/0283145 A1 11/2008 Maxwell
2008/0295462 A1 12/2008 Metzger
2010/0011710 A1 1/2010 Pape
2010/0024363 A1 2/2010 Pape
2010/0263335 A1 10/2010 Pape

(56) References Cited

U.S. PATENT DOCUMENTS

| | | | | |
|---|---|---|---|---|
| 2012/0070264 | A1 | 3/2012 | Pape | |
| 2013/0255194 | A1 * | 10/2013 | Metzger | 53/440 |

FOREIGN PATENT DOCUMENTS

| | | | |
|---|---|---|---|
| EP | 1123884 | A1 | 8/2001 |
| EP | 1696192 | | 8/2006 |
| FR | 2650559 | A1 | 2/1991 |
| GB | 1459629 | A | 12/1976 |
| GB | 2011633 | A | 7/1979 |
| JP | H1-33455 | | 10/1989 |
| JP | H2-41067 | | 3/1990 |
| JP | 05132007 | A | 5/1993 |
| WO | WO0001582 | | 1/2000 |
| WO | WO2008/089762 | | 7/2008 |

OTHER PUBLICATIONS

Office Action and Search Report issued on Jan. 20, 2014 for related CN Patent Application No. 201180044860.X, in 10 pages.

* cited by examiner

RETROFIT ICE MAKING AND BAGGING APPARATUS AND RETROFIT METHOD OF INSTALLATION ON AISLE FREEZER

RELATED APPLICATION

The present application is a Continuation of U.S. patent application Ser. No. 12/580,146 filed on Oct. 15, 2009, which is a Continuation-In-Part of U.S. patent application Ser. No. 12/583,652 filed on Aug. 24, 2009 and entitled Ice Bagging Apparatus, and of U.S. patent application Ser. No. 12/449,132 filed on Jul. 24, 2009 and entitled Method and Apparatus for Making a Medium-Filled Packing, which is the U.S. national stage application of PCT Application No. PCT/DK2008/000027, which claims priority from Danish Patent Application No. PA 200700109 filed on Jan. 24, 2007, and of U.S. patent application Ser. No. 12/583,655 filed on Aug. 24, 2009 and entitled Method and Apparatus for Distributing Articles in a Storage Compartment, which claims priority from Danish Patent Application No. PA 2009 00512 filed on Apr. 21, 2009, and the contents of each of the aforesaid applications are incorporated herein by reference in their entirety.

BACKGROUND

1. Field of the Invention

The present invention relates generally to ice making, bagging and dispensing, and is particularly concerned with a retrofit ice making and bagging apparatus which can be retrofitted onto an existing aisle freezer for dispensing bagged ice in a store, and with a method of installation of the apparatus.

2. Introduction

Many stores such as grocery stores, large stores including grocery departments, convenience stores at gas stations, and the like, have in-line aisle freezers which contain bagged ice cubes for purchase by customers. The storage compartment has an access door which can be opened by a customer to retrieve a desired number of ice bags. Aisle freezers must be re-filled periodically by hand by staff members as they empty, and the bagged ice must be transported to the store by refrigerated transport vehicles. Stand-alone freezers with built-in ice making machines make ice in various forms (cubes or other shapes, crushed ice, and the like), package the ice loosely in bags, and deliver the bags of ice into a storage compartment accessible by customers in supermarkets. Such machines are designed with a top part with an ice cube making unit, a central packing machine which packs the ice loosely in bags, and a lower part with a storage compartment into which the bags are dropped from the packing machine.

In prior ice dispensing or distributing machines, the bagging process involved dispensing ice into pre-made bags which are stored in a magazine in the bagging unit. This is relatively expensive and requires frequent changing of magazines as the bags are used up. Another problem is variation in weight of ice supplied to each bag. Also, the ice can potentially start to melt as it is distributed into bags.

One example of an ice bagging apparatus is disclosed in U.S. Pat. No. 4,368,608. This apparatus comprise an ice maker which is placed above an ice collecting and bagging zone. The ice maker dispenses ice directly into a bag. This causes condensate to enter some of the ice bags during filling when the ice maker has completed a defrost cycle. This has the disadvantage that the water freezes the ice cubes together into bigger solid blocks, which are hard to separate.

SUMMARY

It is an object of the present invention to provide a retrofit ice making and bagging apparatus which can be retrofitted on an existing aisle or in line freezer for dispensing ice in bags, and to a retrofit method of installing the apparatus on such a freezer.

In one embodiment, a retrofit ice making and bagging apparatus is provided, which comprises an outer housing or enclosure having a lower end of predetermined shape and dimensions for securing on top of an existing aisle freezer in a store, the housing having a lower end which is at least partially open to provide an opening which communicates with a storage compartment inside a freezer when the apparatus is installed on top of the freezer, an ice making unit mounted in the enclosure and having an ice supply outlet through which pieces of ice are dispensed, a bag making and filling station located above the lower end of the housing and including a bag forming device which forms film material into bags, the bag forming device having an inlet which receives ice from the ice making unit, and a bag sealing and separating device adapted to seal a bag containing ice and separate the bag from a supply of film material supplied to the bag forming device, the bag sealing and separating device communicating with the opening whereby bags of ice fall into the storage compartment when separated from the bag sealing and separating device.

In one embodiment, the retrofit apparatus also comprises an ice collecting station positioned to collect ice from the ice supply outlet, a film supply feeder, an ice transport device, and a controller. The film supply feeder is adapted to feed two superimposed layers of film from the film supply to the bag making station. The ice transport device is adapted to transport ice from the ice collecting station into a partially formed bag at the bag making station. In one embodiment, the bag making and filling station further comprises a bag fill measurement device which measures the amount of ice supplied into a bag as it is being formed at the bag making and filling station, and the controller communicates with the bag fill measurement device which controls the bag sealing and separating device to complete and seal a partially formed bag at the bag forming station and to separate the sealed bag when an output signal from the bag fill measurement device indicates that a predetermined amount of ice has been supplied to the bag.

The unit is adapted to be retrofitted on top of an existing aisle freezer so that the bag sealing and separating device is located above a freezer compartment of the aisle freezer and sealed bags drop down into the compartment when separated. The ice producing and bagging unit may be secured on top of the existing aisle freezer with any suitable fastener means, such as bolting, welding, or the like.

In one embodiment, one or more sensors are communicatively associated with the controller and designed for installation inside an existing aisle freezer compartment at appropriate heights to detect the fill level in the compartment and to provide output signals to the controller at least when the compartment is filled to a predetermined level. The controller is adapted to shut off the ice supply and transport and the bag making and filling station when the compartment is sufficiently full with packaged bags of ice, and to re-start the ice supply and transport and the bag forming and filling when the level is again below the predetermined level or when it falls to a predetermined low level.

In one embodiment, a partially filled bag is suspended through the open lower end of the housing into the freezer and storage compartment to reduce ice melt during the bag filling process. The bag may be suspended from a frame including load cells for measuring the bag weight, with an output to the controller which stops the ice transport into the bag and controls a bag sealing device to seal the bag, detach it from the adjacent film, and dispense it into a storage area in the storage compartment when a predetermined bag weight is reached.

In order to provide a more even distribution of filled bags into a larger storage compartment, a bag distributor is secured below the bag making and filling station to receive filled bags and dispense them into different regions of the storage compartment depending on the bag level in the respective regions. In one embodiment, the bag distributor unit is suspended below a lower end of the housing which is designed for retrofit attachment to the upper end of an aisle freezer, so that it is located inside the freezer compartment when the ice producing, bagging and dispensing unit is secured on top of the freezer.

According to another embodiment, a method of retrofitting an existing aisle freezer with an ice making and bagging unit is provided, which comprises removing at least part of an upper wall of a freezer compartment of an aisle freezer to provide an opening into the freezer compartment, securing an ice making and bagging unit on top of the upper wall of the freezer compartment so that an ice bagging and filling station in the unit is located immediately above the opening into the freezer compartment, and securing at least one level sensor communicatively linked with a controller in the ice making and bagging unit at a predetermined height in the freezer compartment to detect bag fill level.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which:

FIG. 26 illustrates another embodiment of a bag transport and distributing apparatus for distributing bags to different areas of a bag storage compartment.

DETAILED DESCRIPTION

Figure 1:
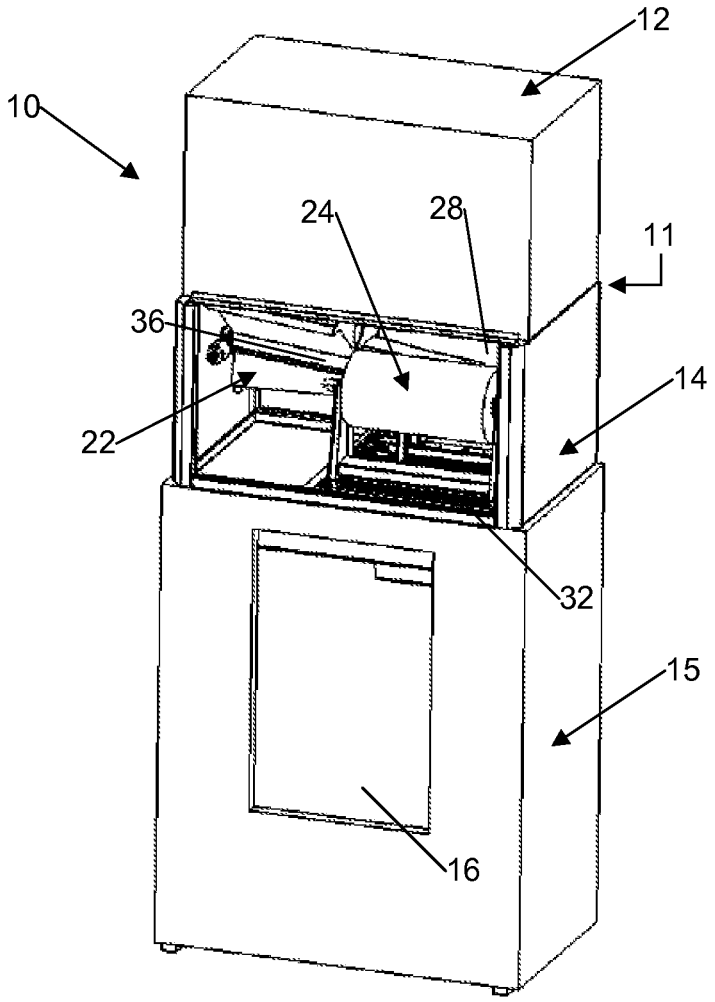
FIG. 1 is a perspective view of one embodiment of a retrofit ice making and bagging apparatus retrofitted on top of an existing aisle freezer.

Certain embodiments as disclosed herein provide a retrofit ice making and bagging apparatus or unit which can be retrofitted on top of an existing aisle freezer, and a retrofit method of installation of the apparatus onto an aisle freezer. After installation, ice in the form of ice cubes, chunks, crushed ice, or the like is supplied from an ice maker in the apparatus to an ice collection station, transported from the collection station to a bag forming station and deposited into a partially formed bag at the bag forming station, the bag is subsequently sealed after sufficient ice is deposited into the bag, and then separated and dropped into a freezer compartment of the aisle freezer onto which the unit is retrofitted.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

In the following description, the terms "ice" or "ice cube" are used for discrete units of ice of any shape, including cube-shapes, oval shapes, crushed ice, granular ice flakes, and the like. Reference in the following description to "filling" bags with ice refers to filling of bags with ice to a predetermined fill level or weight, and does not necessarily mean that bags are completely filled with ice such that no free space remains.

FIGS. 1 to 4B illustrate a first embodiment of an ice producing, bagging and dispensing apparatus 10. Apparatus 10 basically comprises an ice making and bagging unit 11, and a bagged ice storage and freezer compartment or unit 15 having at least one door 16 through which customers can retrieve bags 18 of ice. In one embodiment, the ice making and bagging unit 11 is a retrofit unit designed for installation on top of an existing aisle freezer. The ice making and bagging unit for retrofit installation may have a unitary outer housing, container, or frame which contains or supports the various ice making and bagging components or stations described below and which is of suitable dimensions matching those of an existing aisle freezer so that it can be installed on top of such a freezer. Housings of different dimensions may be provided for different size aisle freezers. The housing may have outer walls or may be of open frame construction on one or more sides or ends. The ice making and bagging unit 11 basically comprises an ice making or supply station 12, an ice collecting station 22, a bag making and filling station 25, a film supply feeder 28 which supplies film to the bag making and filling station, an ice transport device 26, and a controller 35, all enclosed in the outer housing or support frame. In alternative embodiments, apparatus 10 may be provided as a stand-alone, complete unit with its own built-in freezer 15 for installation in a store, gas station, or other dispensing and purchase location, rather than a unit 11 retrofitted on top of an existing in-line or aisle freezer in a store.

Unit or container 11 has a lower wall which is completely or partially open to provide a passageway for bags filled with ice to be dropped or dispensed into the freezer compartment of the retrofitted aisle freezer 15. In one embodiment, the lower wall of unit 11 has an opening 32 located beneath the bag making and filling station to provide a passageway for filled bags of ice into the storage compartment of freezer 15. The arrangement is such that a partially filled bag 44 of ice is suspended through opening or passageway 32 into the freezer compartment to keep the ice cool as the bag is filled. The unit 11 is retrofitted onto the aisle freezer 15 by first forming an opening in the upper wall of the freezer for alignment with opening 32 in the lower wall of unit 11, or completely removing the upper wall of the freezer to provide the freezer compartment with an open upper end. The unit 11 is then suitably secured on top of the freezer as illustrated in FIG. 1. The unit may be secured in place by any suitable mechanical fasteners such as bolts or screws, by welding or the like, or a combination thereof.

The ice making unit or station 12 may comprise a commercially available ice making machine, such as a Hoshizaki SAH-1300 manufactured by Hoshizaki America, Inc., or the like. In the retrofit installation, the ice bag storage compartment is a modified, commercially available aisle freezer 15 as used in supermarkets and other stores, such as freezers manufactured by Leer or Hussmann. The storage compartment may be retrofitted with a plurality of sensors 20 (FIG. 3) secured at appropriate heights in the rear or side walls for detecting the fill level of the compartment. Any suitable sensors, such as optical sensors, may be used for this purpose. Sensors may be positioned to detect an upper fill level and a lower fill level in one embodiment, as described in more detail below. A door open sensor 21 (FIG. 3) is also provided to detect when the storage compartment or merchandiser door 16 is open. This may be an existing door open sensor in the aisle freezer, or may be a new sensor installed in the retrofitting process. In each unit, the internal components or stations for making, transporting, and bagging ice are mounted on a frame and suitably enclosed in an outer container or housing or a single outer housing may enclose the entire apparatus.

Figure 2:
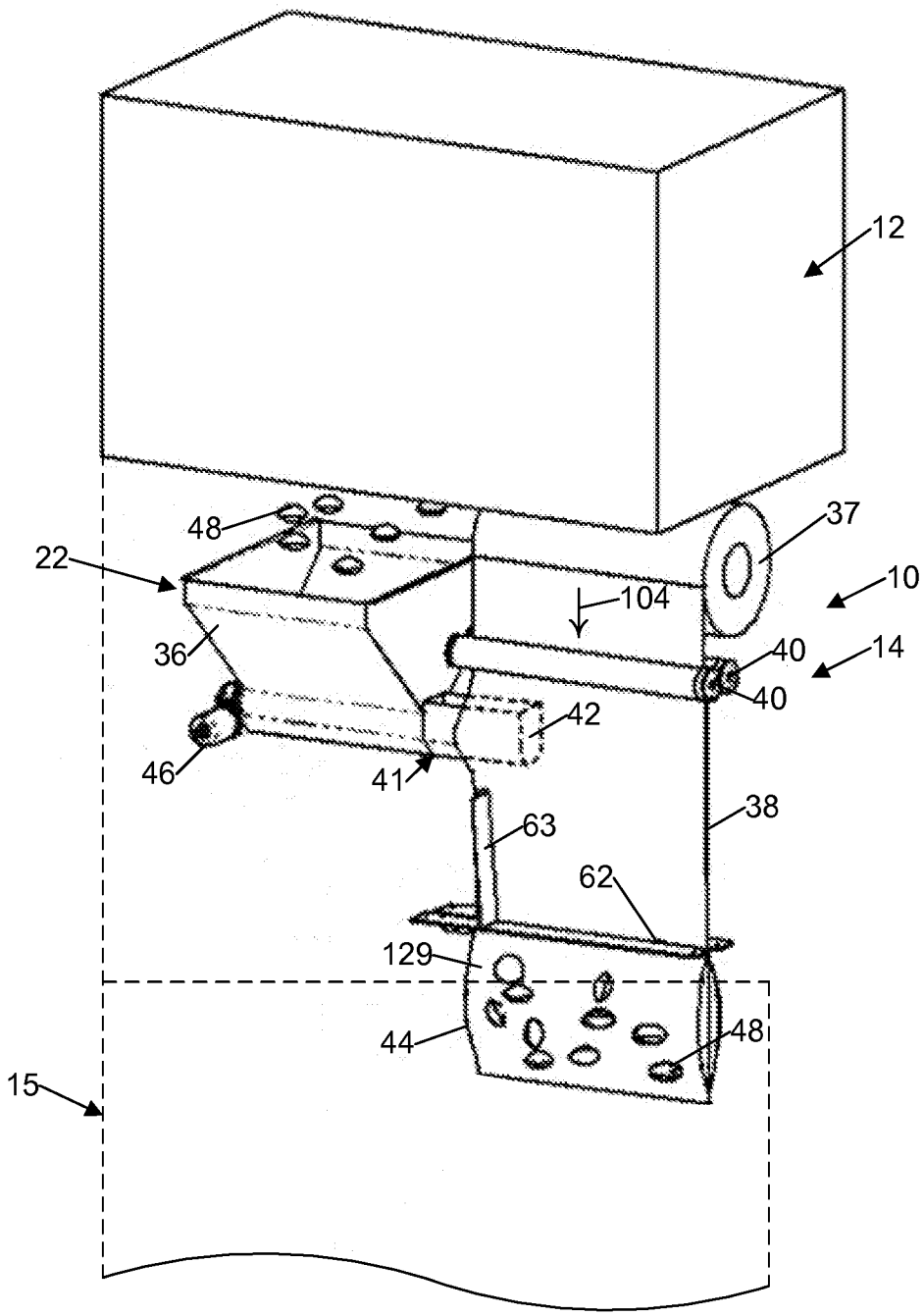
FIG. 2 is a simplified perspective view of the apparatus of FIG. 1 with the outer walls of the two lower compartments of the apparatus removed to reveal the bag making and ice filling structure.
Figure 3:
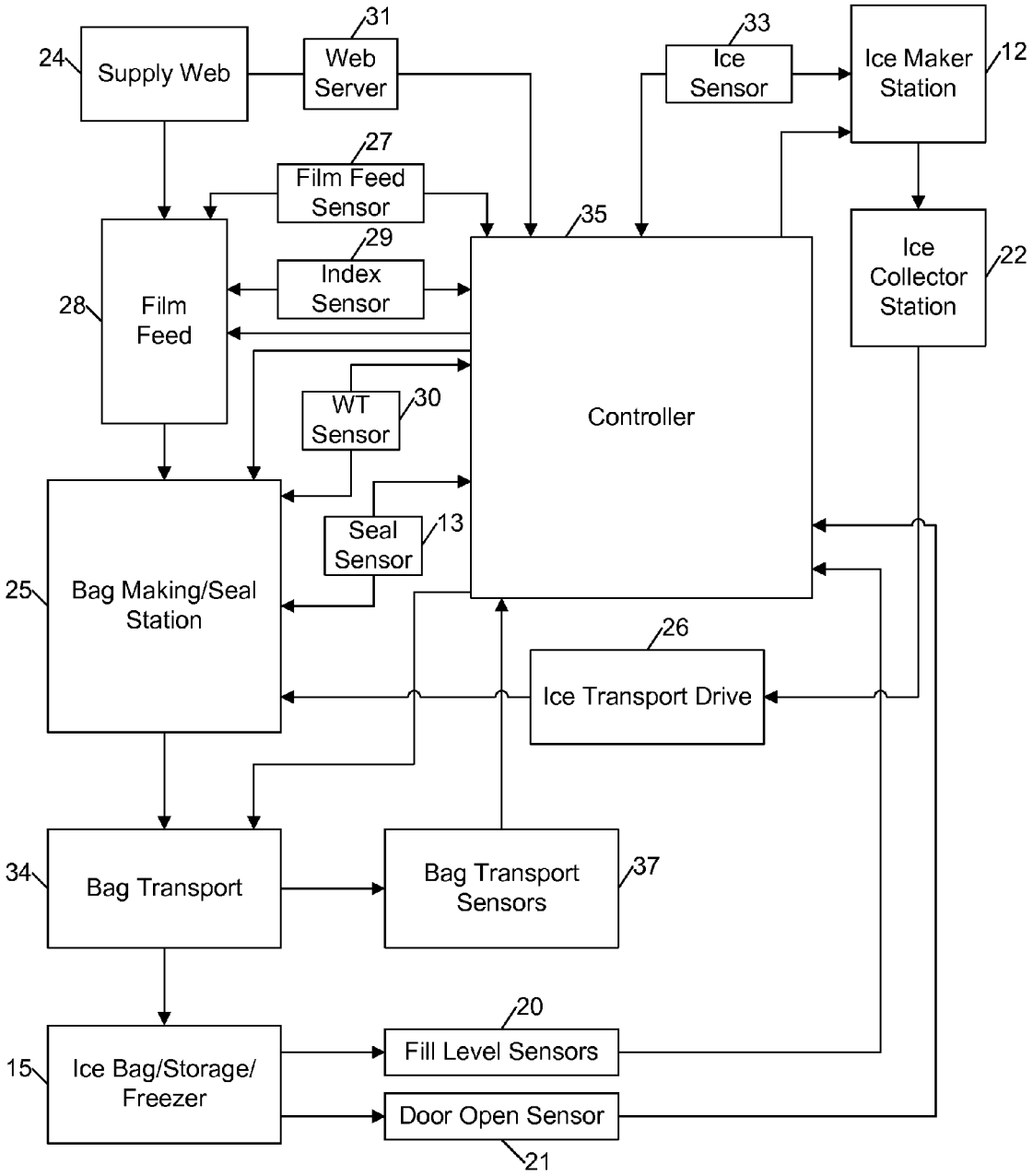
FIG. 3 is a block diagram of the apparatus of FIGS. 1 and 2.

As illustrated in FIG. 2 and the functional block diagram of FIG. 3, the ice collecting station 22 is positioned below an outlet from the ice making station 12. A film or web material supply 24 is provided for supplying material for forming bags to the film feed or film transport device 28 which drives material from supply 24 to the bag making station 25. As illustrated in FIG. 3, various sensors are associated with the stations. A bag fill measurement or weight sensor 30 is associated with the bag making station to detect when a bag is sufficiently filled with ice. A sensor 31 associated with the supply web 24 detects when a new roll of folded web material or film is needed. Seal sensors 13 are also associated with the bag making station to determine the position of seal bars or heating jaws for sealing the bags, as described in more detail below. A film feed sensor 27 and a film index sensor 29 are associated with film feed or transport device 28. The film index sensor detects index marks on the bag material which are spaced one bag length apart. An icemaker sensor 33 is associated with the ice maker 12. Sensor 33 indicates when water is being used to make ice, and indicates that ice supply to the ice collector station can be expected within a few minutes. A door open sensor 21 is associated with the door or doors of the storage and freezer compartment to detect when a customer opens the door to retrieve one or more bags of ice. Operation of all moving parts is stopped on detection of a door open condition.

As illustrated in FIGS. 1 and 2, the bag making station is positioned above the connecting passageway 32 between bag making and filling station 14 and the freezer and storage compartment 15. In the illustrated embodiment, a bag transport or distributing device or station 34 (FIG. 3) is provided to transport bags of ice and distribute bags onto a pile of bags in the storage compartment, although bags may be simply dropped into the storage compartment when filled and sealed in other embodiments. When a distributing device 34 is provided, it may be suspended from the lower wall of the unit 11 so that it is suspended through the open upper end of the freezer compartment and located inside the freezer compartment of an existing in-line aisle freezer when the unit 11 is secured on top of the freezer, as described in more detail below for a larger freezer and illustrated in FIG. 13 in connection with the embodiment of FIGS. 12 to 16. Various bag transport sensors 37 are associated with the bag transport and distributing station, as described in more detail below in connection with FIGS. 17 to 24 which illustrate one embodiment of a bag transport and distributing station incorporating a conveyor.

As illustrated in FIG. 3, a controller or control system 35 is operatively linked with the various stations in the apparatus and also receives outputs from storage compartment fill level sensors 20, door sensor 21, bag fill measurement sensor 30, bag seal sensor 13, film supply sensor 31, index sensor 29, ice maker sensor 33, bag transport sensors 37, as well as any other sensors in the apparatus. The controller 35 may comprise a computer including memory having stored program instructions for controlling operation of apparatus 10. The controller may be positioned within the apparatus 10 and connected via hard wire connections to the various units and sensors, or may be a remote control system which communicates with the components within apparatus 10 via a wireless network or the like. The controller may also be linked via a wireless network or the like with a central control station for monitoring operation of the apparatus and determining when service or repair is needed.

Figure 3A:
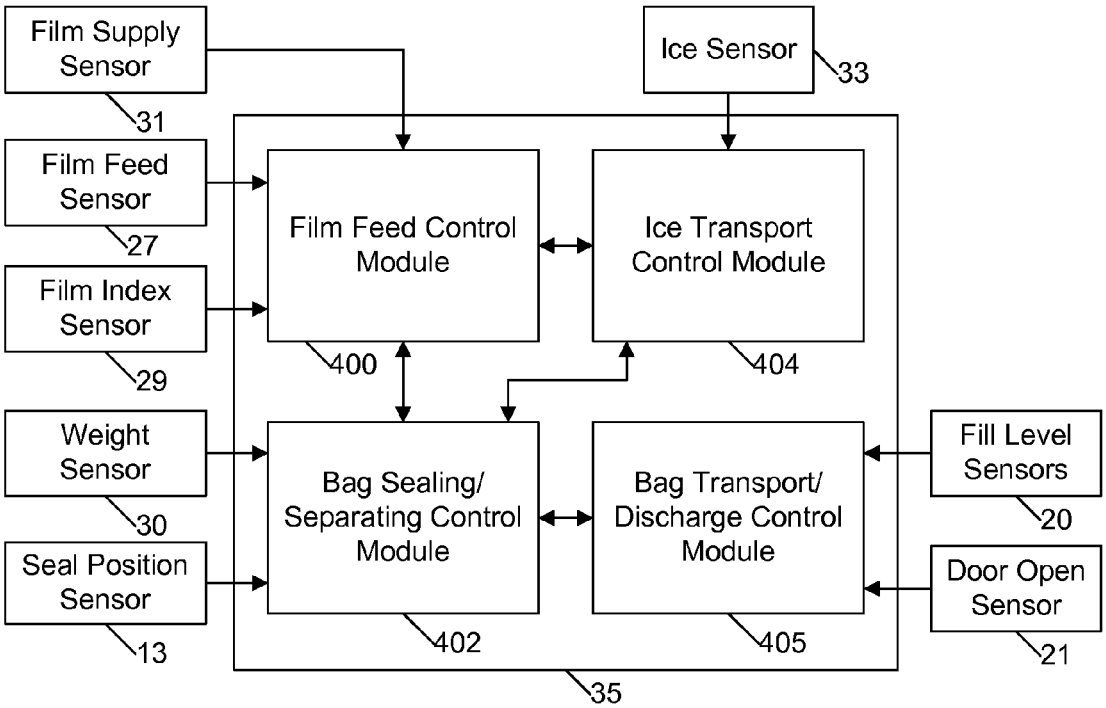
FIG. 3A is a more detailed functional block diagram of the controller of FIG. 3.

FIG. 3A is a functional block diagram of one embodiment of the controller 35. As illustrated in FIG. 3A, the controller 35 comprises a film feed control module 400, a bag sealing and separating control module 402, an ice transport control module 404, and a bag transport/discharge control module 405. The film feed control module 400 controls operation of the film feed device 28 based on inputs from the film supply sensor 31, the film feed sensor 27, the film index sensor 29, and the bag sealing and separating control module 402. In one embodiment, as long as there is sufficient film available in the film supply (based on the output of film supply sensor 31), the film feed control module controls the film feed device 28 to feed one bag length of superimposed film layers into the bag making station 25. Once a first bag has been partially formed, the film feed control module again controls the film feed device 28 to feed a second bag length of film into the bag making station. The ice transport control module 404 controls operation of the ice transport device 26 based on inputs from the ice sensor 33 and bag sealing and separating control module 402. When ice is available in the ice collector station 22 and input is received from the bag sealing and separating module indicating that a partially formed bag is ready to receive ice, the ice transport device is actuated to begin supplying ice to the bag. When input is received from the bag sealing and separating module indicating that a sufficient weight of ice has been supplied to the bag, the ice transport device is turned off.

The bag sealing and separating control module 402 controls operation of transverse and longitudinal bag sealing jaws and a bag separating device at the bag making station based on inputs from the film feed control module 400, the weight sensor 30, and the seal position sensor. When a first bag length of film is fed into the bag forming station and the film feed is paused, as indicated by input from the film feed control module, the bag sealing jaws are closed so as to partially seal a first bag. When sealing is complete, the sealing jaws are opened and a signal is provided to the film feed control module to feed another bag length of film to the bag forming station, so that the partially sealed bag travels through the open jaws towards the storage compartment into an ice fill zone. At this point, the partially sealed bag extends at least partially through the connecting passageway 32 into the storage and freezer compartment 15. Once the film feed is again paused, the bag sealing and separating control module provides a signal to the ice transport control module to begin supplying ice to the bag. When a weight sensor output signal indicates that a desired amount of ice has been supplied to the bag, a signal is sent to the ice transport control module to stop the ice transport. The weight may be re-checked at this point. The sealing jaws are then closed so as to completely seal the bag in the ice fill zone and partially seal the next bag in the bag forming station. Once sealing is complete, the bag separating device is activated to separate the sealed bag from the partially formed bag, and the process is repeated. The bag transport and discharge control module is connected to the bag sealing and separating control module to pick up separated bags and to dispense them into the storage compartment based on input from the fill level sensors 20 and door open sensor 21, as described in more detail below.

Figure 6:
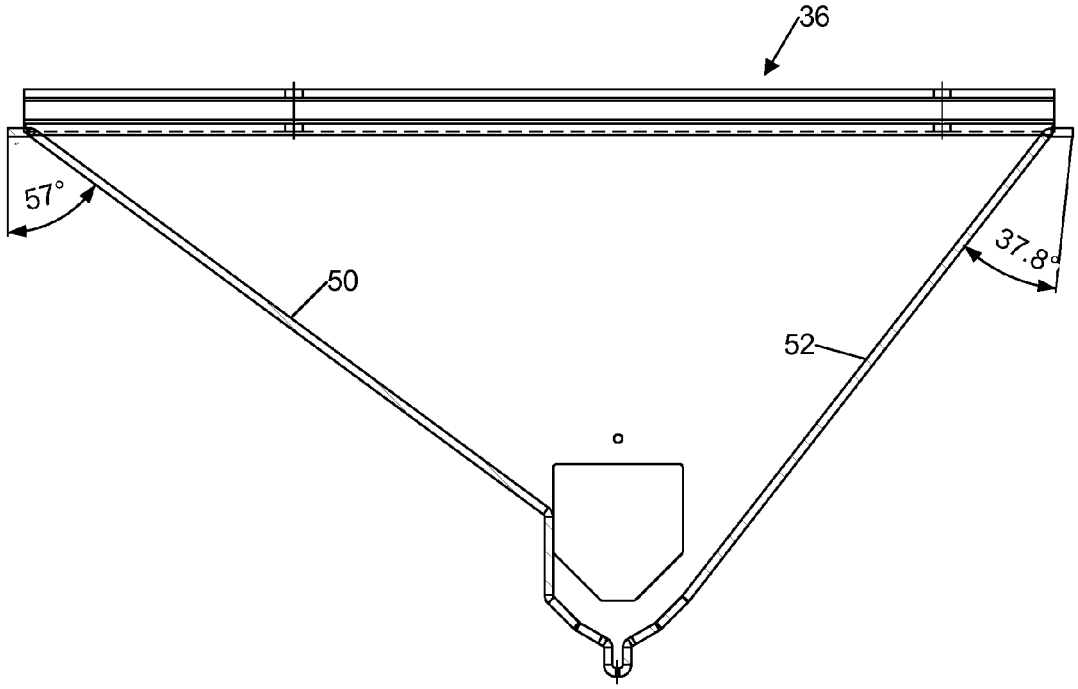
FIG. 6 is a cross-sectional view through the ice collecting station or hopper on the lines 6-6 of FIG. 5.
Figure 7:
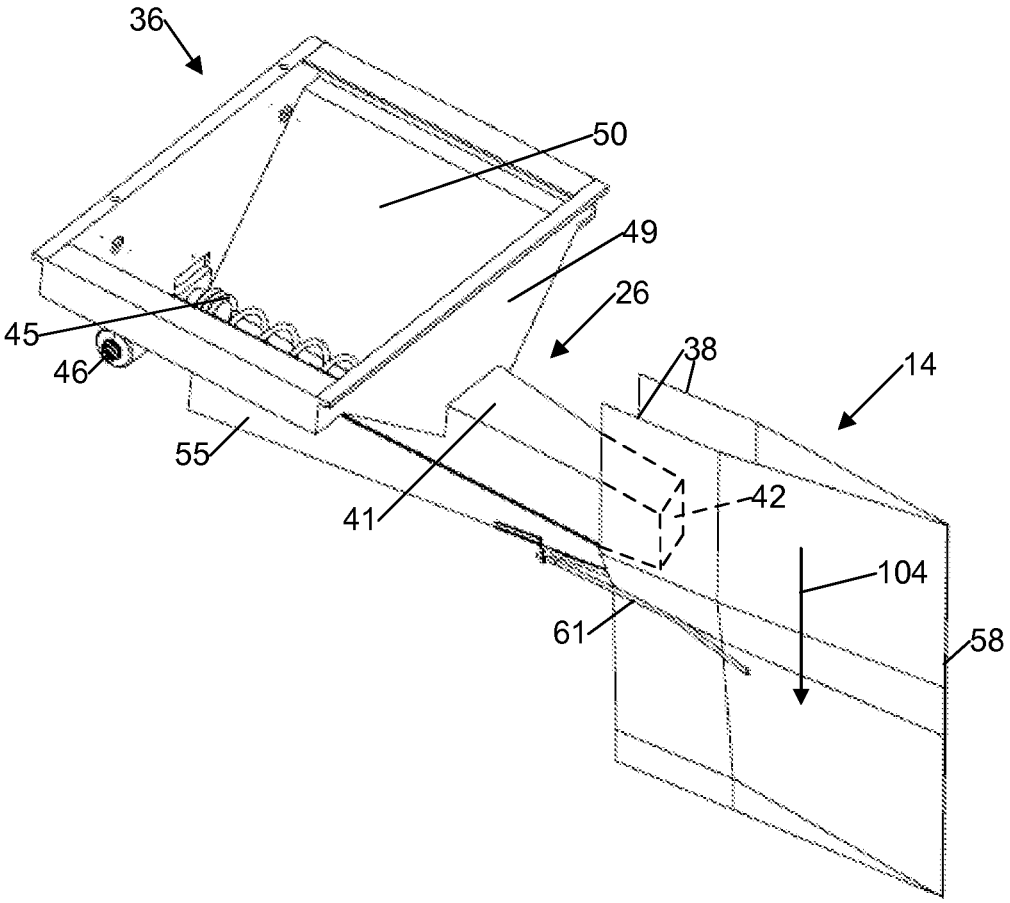
FIG. 7 is a perspective view similar to FIG. 5 illustrating the outlet of the ice transport device disposed in a partially formed bag at the bag making and bag filling station.
Figure 8:
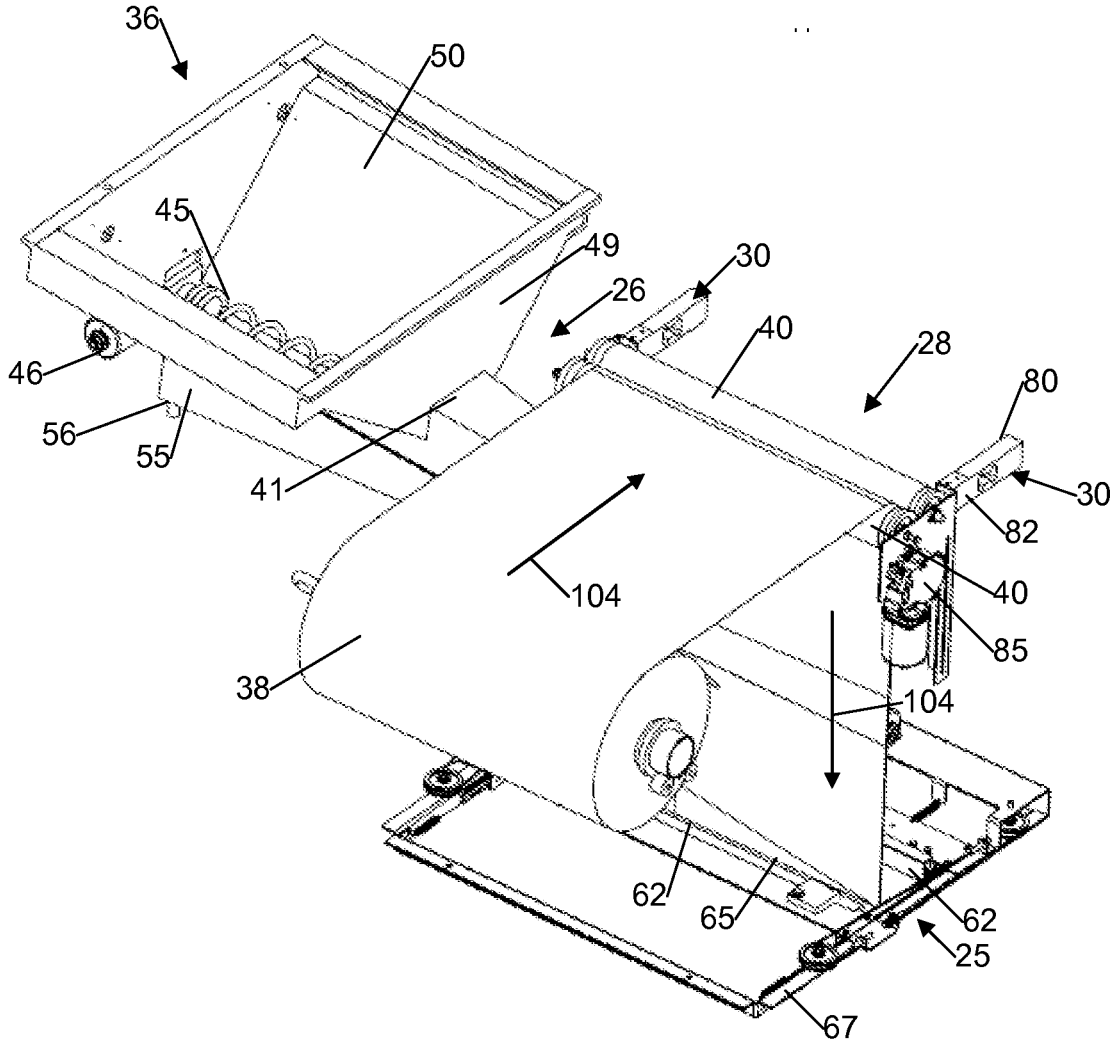
FIG. 8 is a perspective view of the components of FIG. 7 and also illustrating the film feeding mechanism and the bag sealing apparatus at the bag making and filling station.
Figure 9:
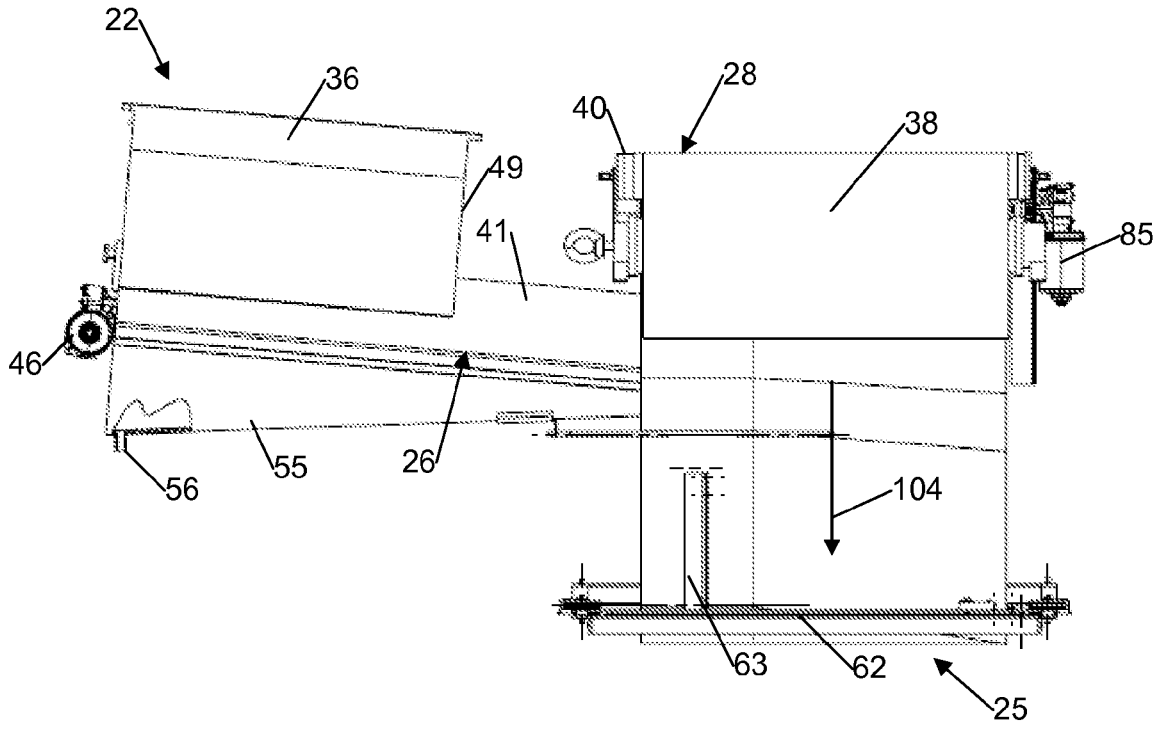
FIG. 9 is a front elevation view of the components of the apparatus shown in FIG. 8.
Figure 10:
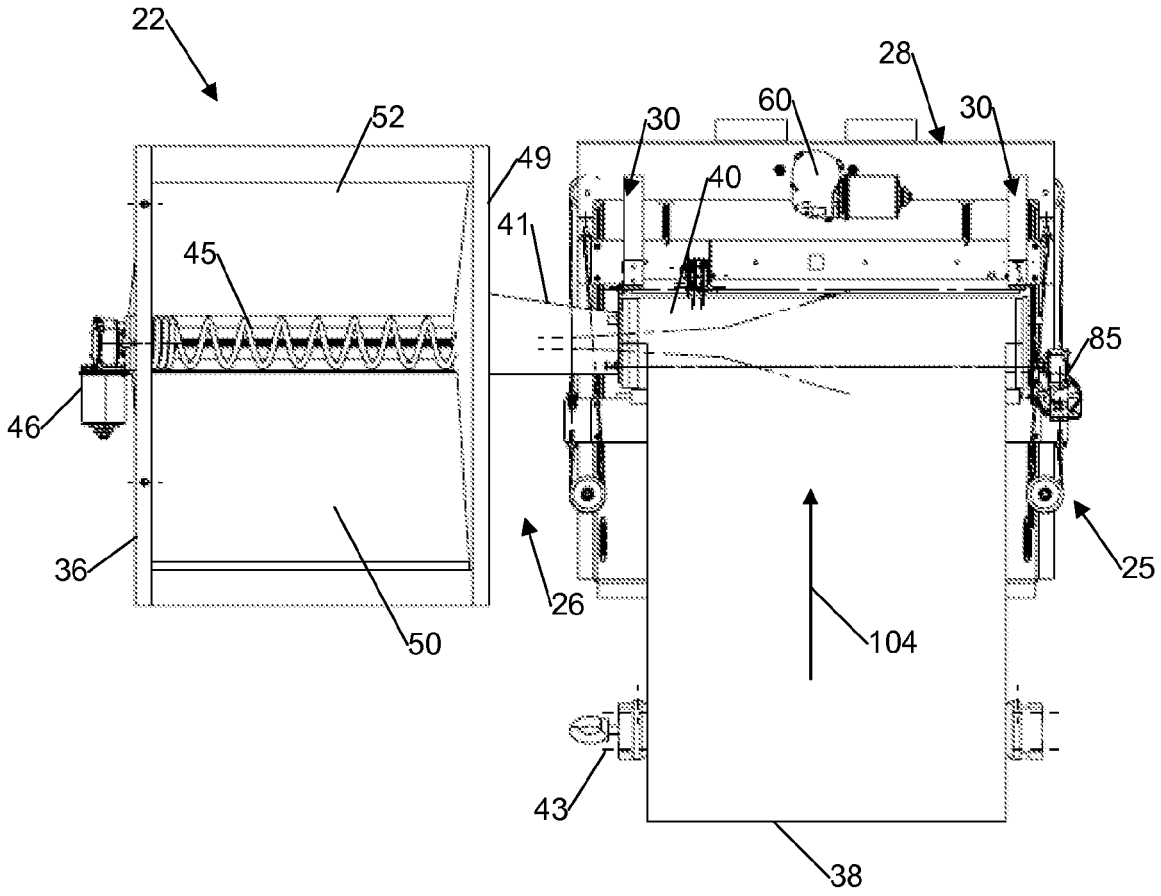
FIG. 10 is a top plan view of the components of FIGS. 8 and 9.

One embodiment of the ice collecting station 22 and bag making and filling station 14 is illustrated in more detail in FIGS. 5 to 11. Ice collecting station 22 comprising a hopper 36 positioned below an outlet from the ice making machine in station or unit 12. Film or web material supply 24 comprises a roll 43 of longitudinally folded web material 38 (see FIG. 8) positioned to supply the web material to transport device 28. Web material feeder or film transport device 28 comprises a pair of opposing rollers 40 positioned behind roll 43, as best illustrated in FIGS. 8 and 10, or alternatively below the roll as illustrated in FIG. 2, and the web material or film 38 is fed between the rollers 40 and into bag making/sealing station 25 positioned below rollers 40. The rollers 40 are rotated by a film feeding or film advance motor 85 which is operationally connected to one of the rollers. The other roller is free wheeling and rotating by contact with the driven roller. The rollers 40 may be urged against one another by any suitable biasing device such as a spring (not illustrated). A suitable film advance sensor 27 such as a Hall sensor detects pulses from the film advance motor to provide a signal to the controller 35 indicating that the film is moving, as indicated in FIG. 3. The folded film or web material 38 is a roll which is replaceable by a full roll when the current roll is empty. Sensor 31 is arranged to detect when the roll requires replacement. This film feeding mechanism allows the folded film web to be controllably advanced in the conveying or film feed direction 104 (FIG. 2) according to the direction in which the rollers are being turned by the film feeding motor under the control of controller 35.

An ice transport chute 41 extends from an outlet of hopper 22 to the bag making station 25. The outlet end 42 of ice transport chute comprises an inlet into the bag making and filling station, and is positioned so as to be located between the layers of folded web material at the bag forming station, extending between the as-yet unsealed side edges of the superimposed film layers 38, and above a partially formed bag 44, as best illustrated in FIGS. 2 and 7. In the illustrated embodiment, the ice transport device 26 comprises a helical drive spring 45 which is driven by motor 46 and which extends through a lower region of hopper 22 and through the hopper ice outlet and along ice transport chute 41 to the exit end of the chute (see FIGS. 7 and 10). The drive spring may be left-handed or right-handed. The use of a spring as the drive device has advantages over known auger or screw drives in that it is smoother and easier to clean and sanitize, because it is center-less and smooth with no welds or joints. This also helps to reduce or eliminate bacteria build up.

As ice drops from the ice maker unit into the hopper (see FIG. 2), the drive spring transports the ice towards the hopper outlet and along the transport chute. If multiple ice cubes or pieces become stuck together into a large lump as a result of defrosting, the drive spring tends to crush and separate the lump. This is because a large lump which is larger than the outlet opening is liable to become pinned between a turn of the helical spring and an end wall 49 of the hopper prior to entering the chute. The drive spring motor then builds up energy in the spring, by deforming or compressing it axially and radially until the energy stored in the spring reaches a level which is sufficiently high to break the ice lump into smaller pieces, which are then able to enter the chute. The build up of torque in the drive spring motor for a helical spring drive spring is gradual, in contrast to a screw drive or auger, where the torque built up is near instant, because a screw drive or auger generally is stiff or rigid, so that large lumps of multiple ice pieces can result in jamming of the ice drive mechanism. The material for the helical spring may be stainless spring steel wire according to European norm EN10270-3 or other similar materials.

As illustrated in FIGS. 5 to 8, the hopper 36 has parallel end walls 49 and opposite angled side walls 50, 52. The side walls may be symmetrical and oriented at the same angle. In an alternative embodiment, as illustrated in FIG. 6, the side walls 50, 52 may be at different angles, with wall 52 oriented at a steeper angle than wall 50. In one embodiment, the angles of walls 50 and 52 to the vertical were around 54 degrees and 38 degrees, respectively. This asymmetrical design reduces the risk of bridging where a bridge of ice cubes forms across the hopper, potentially slowing down or jamming the ice feed. Instead, the different angles of the side walls help to allow the ice to rotate in a circular motion and topple inwardly towards the drive spring at the bottom of the hopper. The walls 50 and 52 are arranged so that the drive spring rotates towards the shallower angle wall 50, providing more space for ice to rotate towards the wall 50 and topple down into the lower region of the hopper to be picked up and transported out of the hopper by the drive spring.

In the illustrated embodiment, the guide or transport chute 41 has one or more drain openings 54 in its lower wall (see FIG. 5, where part of the drive spring in chute 41 is omitted to reveal the openings), and a drip pan or drain channel 55 extends beneath the chute 41 to collect melt water draining from the chute. Drain channel 55 may be downwardly inclined with a drain outlet 56 at its lower end. In an alternative embodiment, the chute has a smaller drain channel or trough which extends beneath the chute to receive water runoff. The drain trough has multiple drain holes along part or all of its length to eliminate water runoff, and may be formed integrally with the chute 41 or attached separately. Water melted off the ice cubes inside the chute 41 tends to drip down into the drain channel and is then drained from the channel in any suitable manner. In one embodiment, a drip pan may be positioned underneath the chute to catch the water dripping from the openings in the drain trough or channel. Any water condensing on the outside of the chute may also be collected in a drip pan. The helical drive spring 45 which transports ice along the chute 41 also helps to carry any excess melt water out of the chute into the drain trough, reducing the amount of water delivered into the bags 44 along with the ice cubes or pieces. This arrangement can act to dry the ice so that the chute and channel act as an ice dryer. This also reduces the tendency of ice cubes in the finished bags to stick together as a result of melt water re-freezing when the bags are stored in the freezer compartment.

The bag forming station 25 is illustrated in more detail in FIGS. 8 to 11. As illustrated, the bag forming station comprises a film or web sealing or welding apparatus having opposing transverse sealing or welding jaws 62 which extend transverse to the film feed direction, and opposing longitudinal sealing or welding jaws 63 which extend in the film feed direction. The welding jaws are movably mounted on a rectangular support frame 67 secured in the housing and driven back and forth between an open position spaced from the film 38 (FIGS. 8 and 11) and a closed position in which the two film layers are squeezed between the opposing jaws by sealing jaw drive motor 60. The folded film sheet 38 is fed down from the feed rollers 40 through the welding apparatus 25 with the lower end or partially formed bag 44 extending downwardly from the apparatus 25 into the freezer compartment 15 so that ice dropping down into bag 44 from the chute end 42 is within the freezer. This arrangement reduces melting of the ice as the bag is completed. The bottom end of the film webs is welded together by a welding apparatus 25 before the partially formed bag is conveyed downwardly to the position illustrated in FIG. 2.

As described above, the bags are formed from a longitudinally folded sheet of web material, so that one longitudinal side edge is already closed via the fold 58 (see FIG. 7). The opposite longitudinal side edges are open as the material is fed downwardly from rollers 40, and are sealed by vertical or longitudinal sealing jaws 63 in the conveying direction 104, starting below the exit end 42 of the ice feed chute 41 (see FIG. 9). The opposite side edges are held together by V-shaped guides 61 mounted on the outside of drain channel 55 immediately above vertical sealing jaws 63. The sealing device may comprise opposing thermal welding jaws. In an alternative embodiment, the web material may comprise two separate superimposed sheets of film material, and in this case longitudinal sealing devices or welding jaws are provided along opposite side edges of the sheets.

The horizontal welding jaws 62 are reciprocally driven together and apart by welding or sealing jaws drive motor 60 between a closed position where the jaws are in contact with the film webs 38 and an open position away from the film webs 38. Proximity switches or seal position sensors 13 (see FIG. 3, not visible in FIGS. 8 to 11) are provided on the frame 67 to detect when the sealing bars or jaws are in the closed, sealing position and in the open position. The bag sealing control module 402 of the controller is programmed to coordinate operation of the welding jaws so that the jaws are spaced apart while one bag length of material is fed through the welding apparatus and ice is supplied to the bag via the chute 41 and the bag weight is measured. The jaws are brought together to weld the upper end of the bag shut as soon as the bag reaches the desired weight, as described in more detail below.

A suitable bag weight measurement device 30 is used to measure the weight of the partially formed bag 44 as ice is introduced into the bag. Any suitable weighing device may be used. In one embodiment, the film supply roll, web feeding rollers 40, and welding apparatus are all mounted on the frame of housing unit 14. In one embodiment, the measurement device may comprise a weighing scale such as an electro-mechanical scale coupled to controller 35. The scale may include a base 80 and a weighing pan 82, wherein the base is attached to the frame, and wherein the pair of drive or feed rollers are suspended from the weighing pan and the bag 44 in turn is freely suspended from the rollers. The longitudinal and transverse welding jaws are open during weighing. The weight is measured during filling and then verified when the ice feed motor is turned off, since ice may be settling during filling and may cause an incorrect weight measurement.

In an alternative embodiment, the weight measuring device may comprise a strain gauge scale or one or more load cells which are interconnected between the housing frame and the pair of rollers 40 or provided on a bag holder on the frame. The bag is weighed while hanging freely from the rollers 40 with all welding jaws open.

Figure 11:
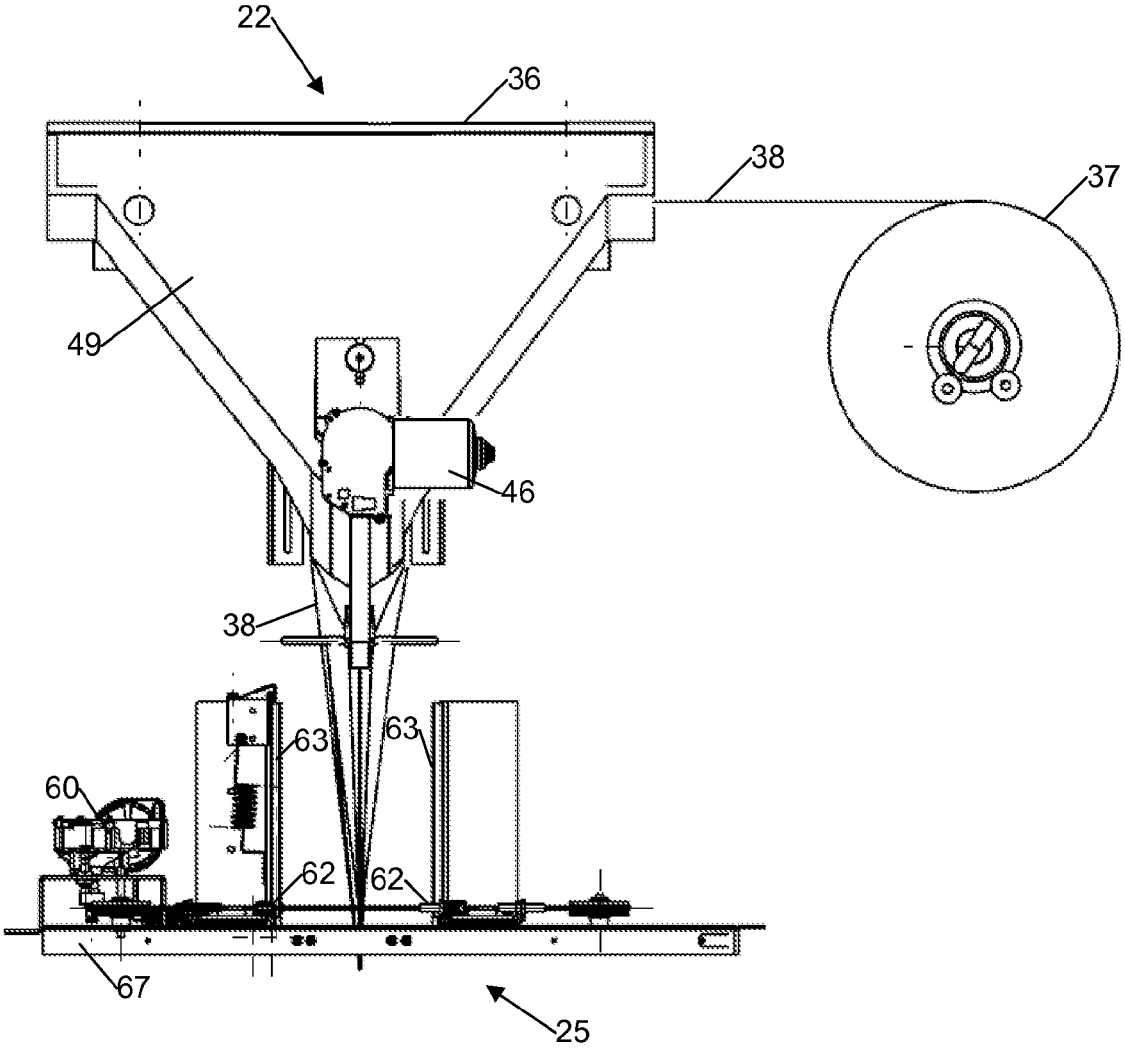
FIG. 11 is a side elevation view of the components of FIGS. 8 to 10.

As illustrated in FIG. 11 and described above, the longitudinal and transverse welding jaws 63, 62 on each side of the film may be movably mounted on a frame 67 via a single carriage or transport mechanism so that they are moved together and apart simultaneously, or may be driven separately in other embodiments. The welding jaws are reciprocally driven by welding jaws drive motor 60 between a position where the jaws are in contact with the film webs 38 and a position away from the film web 38. In one embodiment, the longitudinal and transverse welding jaws are actuated independently, so that the longitudinal sealing occurs separately from the transverse sealing of a bag.

When the bag is filled with the desired amount of ice, the upper end of the bag is sealed by closing and heating the transverse welding jaws, and the filled ice bag is separated from the film web by a separating device 65 and distributed into the storage compartment. Separating device 65 may comprise a heated jaw or a heated thread integrated with the welding jaws which establish the separation by melting the film webs. Alternatively a cutting edge may be used. The lower end of the next bag may be sealed at the same time as the upper end of the completed bag is sealed shut and separated from the web material. During separation of the ice filled bag, the bag is supported either by means within the welding apparatus, an external gripper, or a platform supporting the bottom of the bag, since otherwise the cut or separation line may not be straight.

Once a bag has been filled and separated from the remainder of the film or folded web, the welding jaws are again opened and the roller drive motor is actuated to feed a new bag length of material, as determined by film feed sensor 27, with the partially formed bag adjacent the previously separated bag fed down through the open welding jaws of the welding apparatus. The roller drive motor is then turned off and the ice drive spring is driven to transport ice into the next partially formed bag. The process is then repeated to complete another bag of ice.

In one embodiment, the transverse and longitudinal sealing steps are performed separately, although they may be performed at the same time in other embodiments. In one embodiment, when a partially formed bag is fed into the ice filling zone and a new bag length is in the bag forming zone, the sealing jaws are shut with the longitudinal sealing jaws actuated to seal the side edge of the new bad, while the transverse-sealing jaws are off. The jaws are then opened while ice is supplied to the partially formed lower bag. After sufficient ice is supplied to the partially formed bag in the ice filling zone, the jaws are closed with the longitudinal sealing jaws turned off and the transverse sealing jaws are heated to form a transverse seal across the intersection between the bags. The completed bag is then separated from the remainder of the web. The longitudinal sealing may be performed in one or more steps.

Figure 4A:
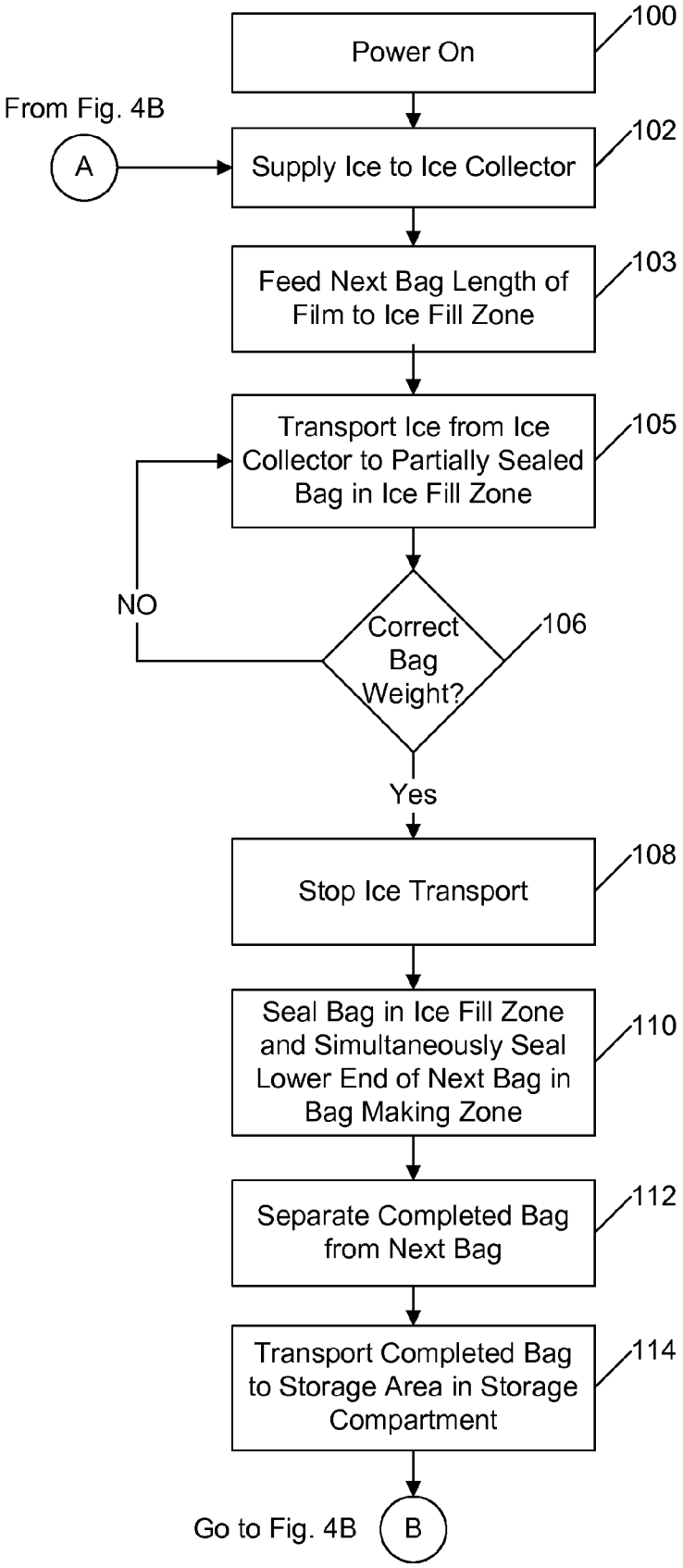
FIGS. 4A and 4B are flow diagrams illustrating one embodiment of a process for supplying, bagging, and dispensing bags of ice.
Figure 4B:
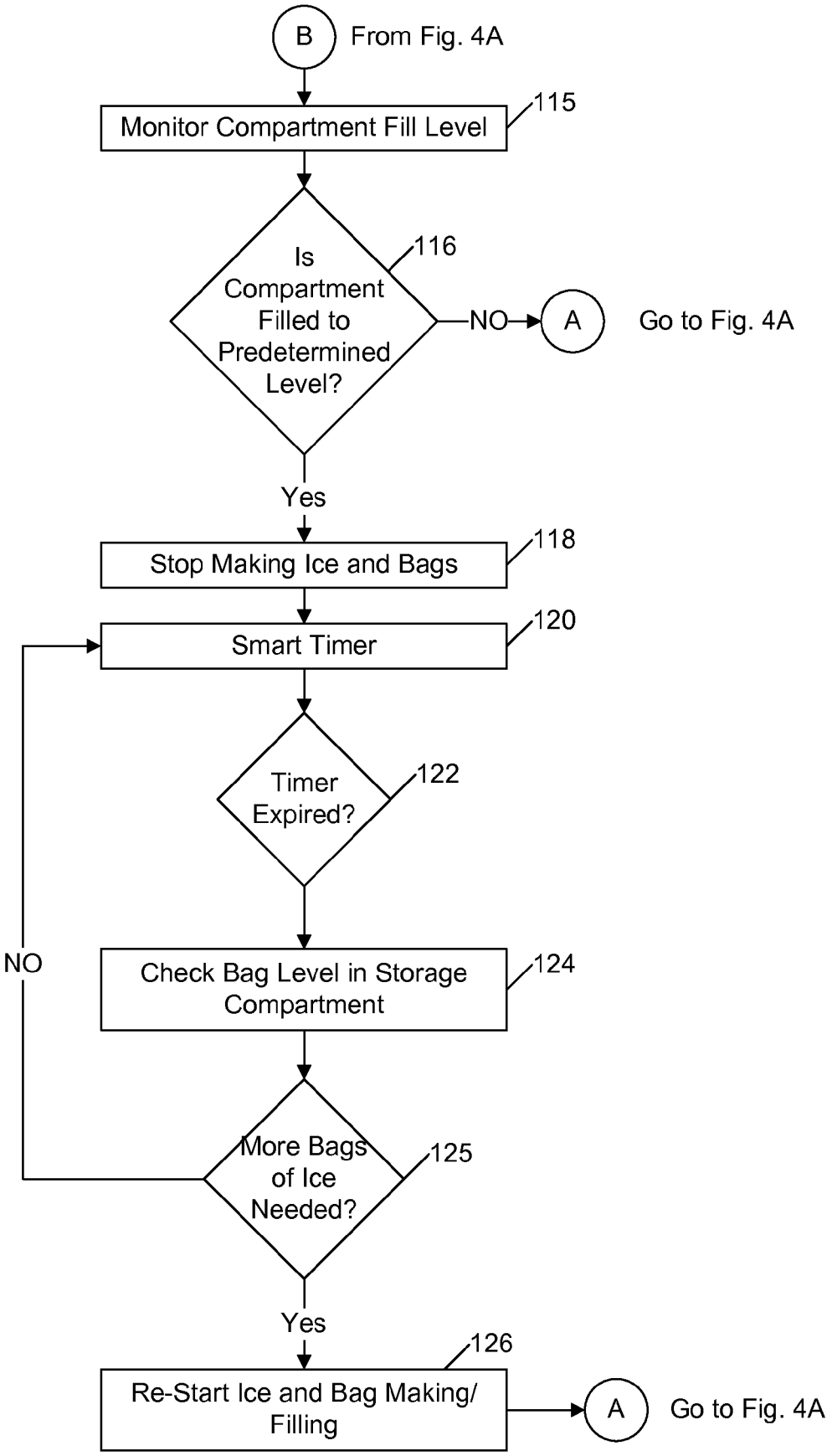
Figure 5:
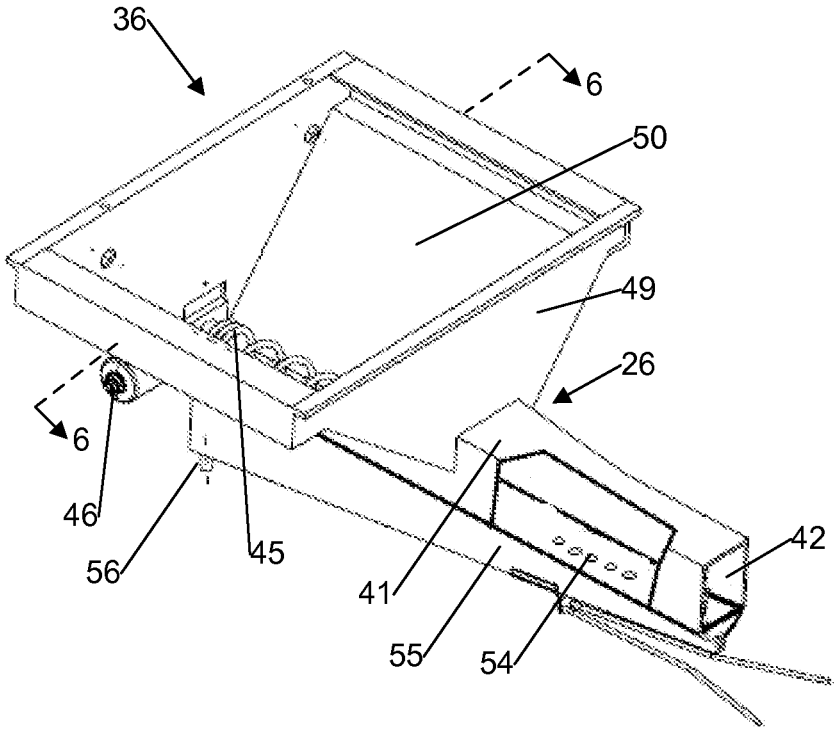
FIG. 5 is a perspective view illustrating one embodiment of the ice collecting station or hopper and ice transport device of FIGS. 2 and 3.

FIGS. 4A and 4B illustrate one embodiment of a method for making, bagging, and dispensing ice using the apparatus of FIGS. 1 to 11. As illustrated in FIG. 4A, when power to the apparatus is switched on (100), a system check is first performed to make sure all stations are operating correctly, and a maintenance required message is sent or displayed if any errors are detected. The ice maker station 12 is then switched on (step 102) to begin making and supplying ice to the ice collector station or hopper 22. The ice may be in any typical shape, including cubical as well as oval and other conventional ice types such as shavings or flakes. Simultaneously, the bag feed motor is switched on to advance the folded film material by one bag length (as determined by the film index sensor), with the sealing jaws in the open position as determined by the proximity switch or sensor for that position (step 103). This feeds any partially formed bag previously in the bag forming zone above the welding apparatus frame 67 down between the open jaws and into the ice filling zone beneath the jaws and inside the freezer compartment, and places a subsequent bag length of film in the bag forming zone. At this point, once the film feed is stopped (as determined by the film index motor sensor 27) the jaws may be closed with the transverse sealing jaws inoperative, and the longitudinal sealing jaws operative, so as to form a side edge seal in the bag length above the welding apparatus frame 67. The jaws are then opened. When the jaws are in the open position, as detected by the proximity switch, the controller activates the ice transport motor 46 to rotate spring 45 and transport ice from the ice collector, along chute 41, and into the partially formed bag 44 suspended below the welding apparatus (step 105).

As ice is supplied to the partially formed bag with the welding jaws open, the controller monitors the bag weight based on the load cell output (step 106), and turns off the ice feed drive motor 46 when a predetermined weight of ice is detected (108). The system may be programmed to perform another weight check when no ice is being supplied to the bag, to make sure the weight is correct after ice settling. The welding jaws are then closed so that a seal is formed across the top of bag 44 (step 110) as well as across the lower end of the next bag to be formed, and the sealed bag is then separated from the remainder of the web by the separating device, such as a heated jaw or thread 65 or a cutter (step 112). The separation line is across the transverse weld or seal so that the upper end of one bag remains sealed while the lower end of the next bag is also sealed. The bag is then transported into the storage area or freezer compartment 15 (step 114).

As illustrated in FIG. 4B, the controller continuously or periodically monitors the freezer compartment fill level (step 115) by monitoring the outputs of fill level sensors 20. If the compartment is not filled to a predetermined level at step 116, indicating there is still space in the compartment, the process returns to step 102 of FIG. 4A to continue making ice, feeding more folded film material, and forming and filling bags. If the compartment is filled with bags of ice to the predetermined fill level at step 116, the ice making unit 12 and bag making unit 25 are switched off (step 118), and a timer is started (step 120). When the timer expires (step 122), the bag level in the storage compartment is again checked (step 124) to see if it is below the predetermined fill level, due to customers retrieving bags of ice from the compartment or bagged ice dispenser for purchase. If the bag fill level indicates no more bags of ice are needed (125), the timer is re-started at step 120, and the procedure is repeated. When the bag fill level has fallen below a predetermined fill level and more bags of ice are needed, the process re-starts (126) and returns to step 102 to start making ice and bags and filling the bags with ice again.

If the door of the merchandiser or bagged ice storage compartment 15 is opened by a customer at any stage in the process described above, the bag filling and sealing steps and operation of all other moving parts are stopped until the door is closed. This avoids or reduces the risk of filled bags of ice being dropped into the compartment while a customer is reaching in to retrieve and purchase a bag of ice.

In one embodiment of a method for retrofit installation of ice making and bagging apparatus 11 onto an existing aisle freezer 15, an upper wall of freezer 15 is first removed to provide an opening into the freezer compartment, or an appropriate opening is cut into the upper wall. Apparatus 11 is then placed on top of the freezer 15 so that the openings in the lower end of apparatus 11 and the upper end of the freezer are aligned to provide a passageway into the freezer compartment. The ice producing and bagging apparatus may then be secured on top of the existing aisle freezer with any suitable fastener means, such as bolting, welding, or the like.

FIGS. 12 to 25 illustrate another embodiment of a retrofit apparatus 200 and method for making and bagging ice which has higher capacity and is designed for retrofit installation onto a larger existing aisle or in-line freezer 204 which has a larger storage compartment for holding bags of ice than the previous embodiment, as well as a modified bag transport and distributor station 90 which is linked with controller 92 (see FIG. 16) in order to control distribution of bags of ice to different zones or areas of the storage compartment. Some parts of the apparatus of FIGS. 12 to 25 are identical to parts in the previous embodiment, and like reference numerals are used for like parts as appropriate. Although the following description describes a retrofit installation on top of an existing aisle or in-line freezer previously installed in a store, the entire apparatus illustrated in FIGS. 12 and 13 may alternatively be provided as a new, stand-alone unit with its own freezer 204 in other embodiments.

Figure 12:
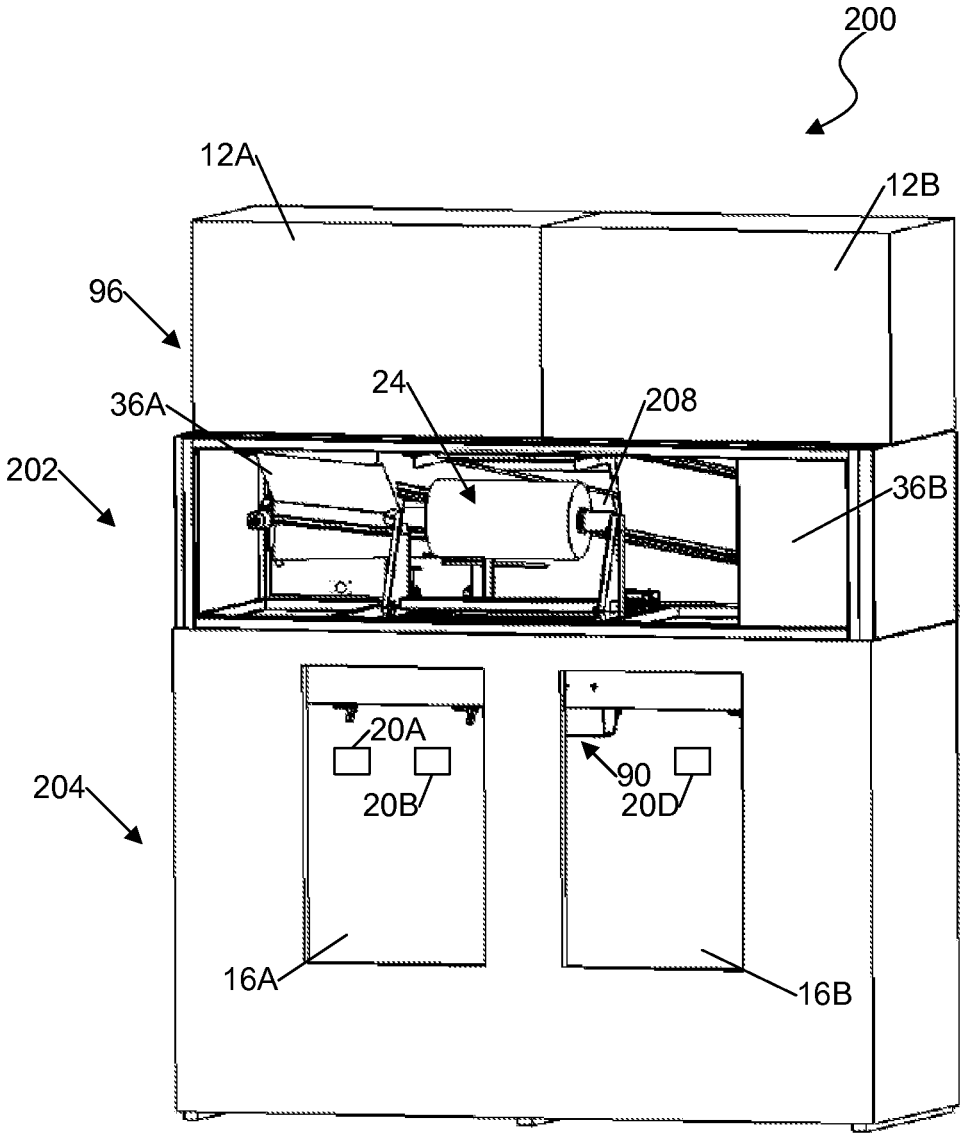
FIG. 12 is a perspective view of a second embodiment of a retrofit ice making and bagging apparatus retrofitted on top of an aisle freezer which has a larger ice bag storage compartment and greater ice making capacity than the first embodiment.
Figure 16:
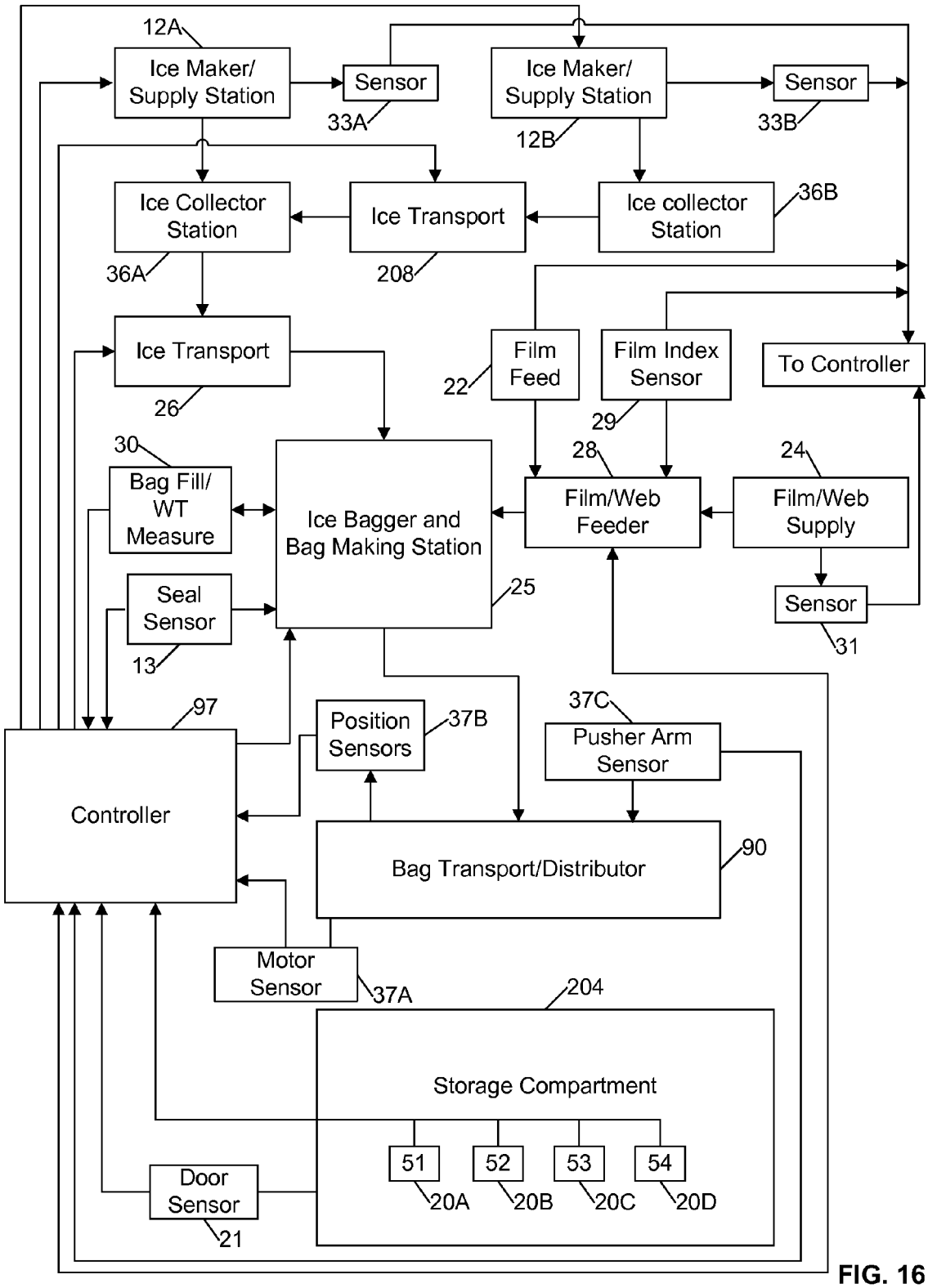
FIG. 16 is a block diagram of the apparatus of FIGS. 12 to 14.

The retrofit unit 200 of FIGS. 12 to 25 may comprise a single outer housing or frame or separate housings for the some of the stations which are secured together to form a single retrofit unit of suitable size for fitting on top of the larger freezer 204 of FIG. 12. An upper part of unit 200 comprises an ice making station 96 which has first and second ice makers 12A and 12B, and a lower part 202 of unit 200 has an ice collection station as well as a bag making and filling station and transportation device for transporting ice from the ice collection station to the bag making and filling station. The retrofit unit 200 is installed on top of freezer 204 in the same way as described above in connection with the first embodiment. As illustrated by the broken away section of the lower part of the front wall of the merchandiser or storage/freezer compartment, four adjacent storage zones or regions 205A, 205B, 205C and 205D where completed bags 206 of ice are collected are each associated with respective fill level sensors 20A, 20B, 20C, 20D, which may be mounted during the retrofit installation on the rear wall of the freezer compartment, or on opposing front and rear walls of the compartment where the sensors are photosensors, for detecting fill level in each zone. Each sensor 20A, 20B, 20C, 20D is communicatively linked with the controller 92, as indicated in FIG. 16. Door sensors 21 may also be installed on each door to detect when the door is opened. The freezer 204 has two doors 16A and 16B in the illustrated embodiment, but may comprise three or more in-line freezer compartments or areas in alternative embodiments, with each compartment having its own door. The doors may be larger than shown in FIGS. 12 and 13, and may comprise the entire front wall of each freezer compartment in some cases, as is known with existing aisle or in line freezers.

Figure 13:
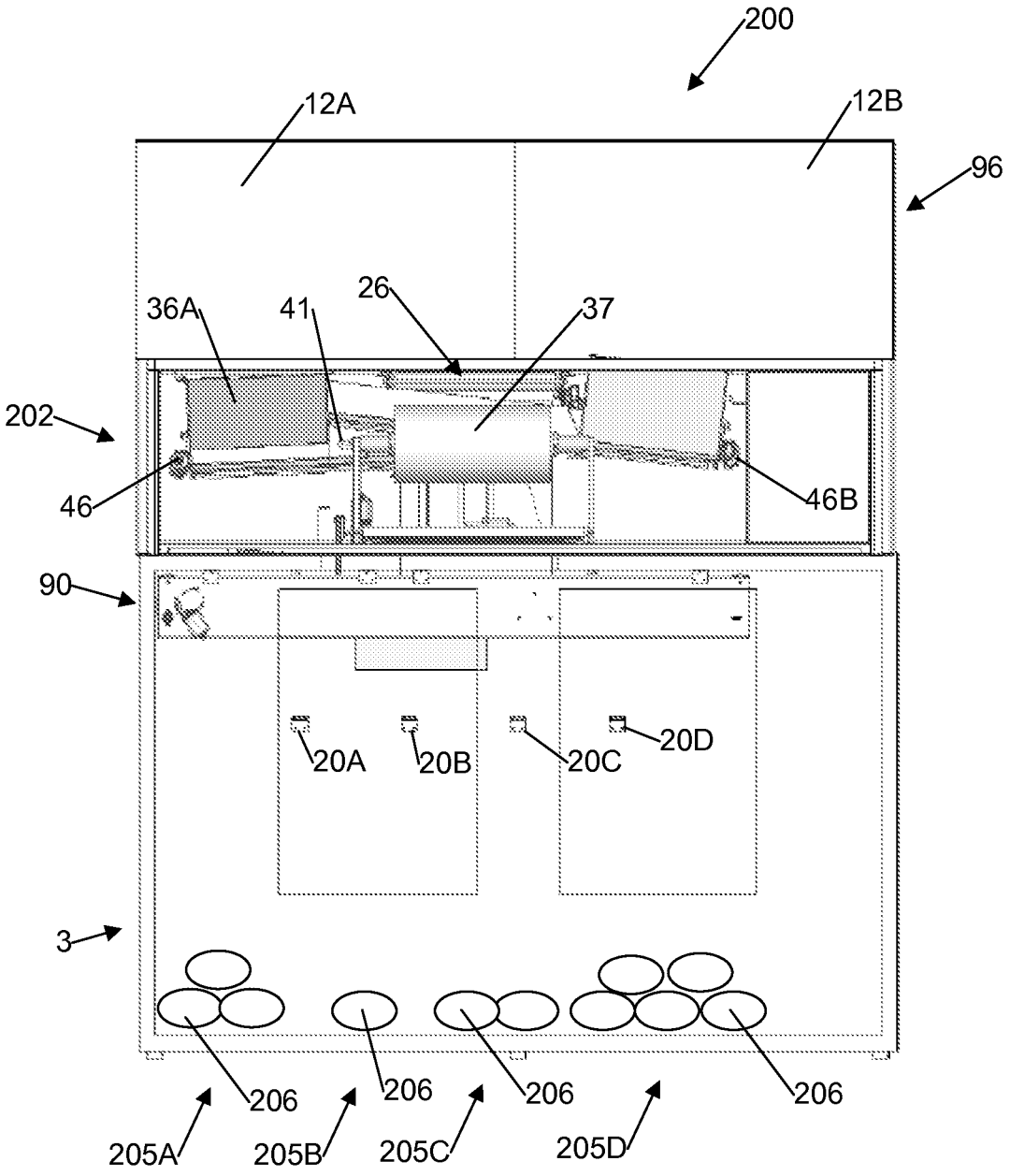
FIG. 13 is a front elevation view of the apparatus of FIG. 12, partially broken away.

A bag transport and distributor station 90 is suspended from the lower wall of unit 200 so that it is located within the freezer compartment as illustrated in FIG. 13 when the unit 200 is retrofitted on top of freezer 204. Bag transport and distributor station 90 has a horizontal conveyor mechanism which can dispense filled bags of ice to any of the four zones of the storage compartment, depending on outputs from the four fill level sensors, as described in more detail below.

As in the previous embodiment, the apparatus 200 may comprise a retrofit unit for installation onto an existing aisle or in-line freezer 204 in a store, or may be part of a new, stand-alone unit including its own freezer compartment. In a retrofit installation, the upper wall of freezer 204 is removed or an opening is cut into the upper wall to provide a passageway between the ice collection and bagging station and the storage compartment of the freezer, and the retrofit unit is then secured on top of freezer 204 so that bag transport and distributor station 90 is suspended from unit 200 into the storage compartment, above the storage zones. The door sensor and fill level sensors are mounted at appropriate locations in the existing freezer compartment.

A single film supply 37 and a single film feed device 28 including rollers 40 supply film to the bag making and filling station 25, and these parts of unit 200 are identical to those of the previous embodiment. However, in this embodiment, instead of a single ice collector or hopper, there are two ice collectors or hoppers 36A and 36B, one positioned under the outlet of the first or left ice maker 12A and the other positioned under the ice outlet of the second or right ice maker 12B.

Figure 14:
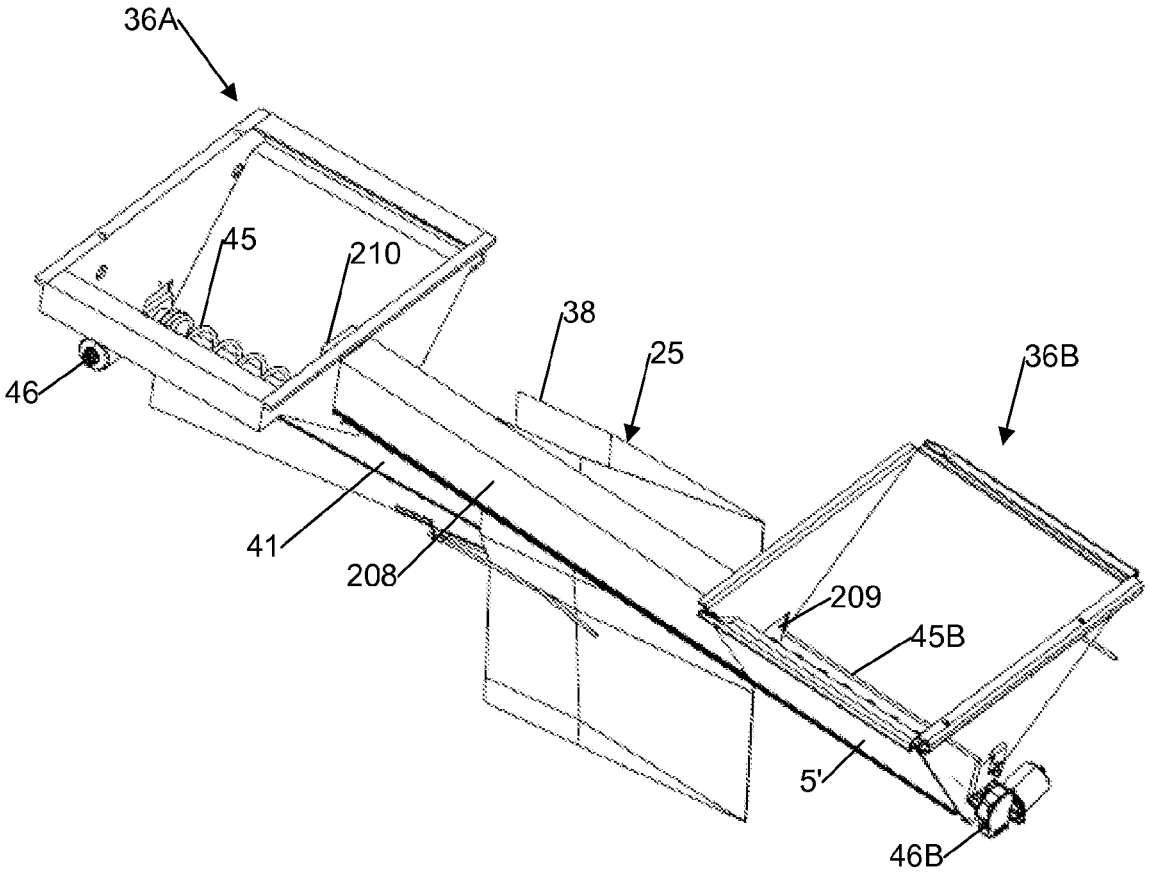
FIG. 14 is a perspective view illustrating the two ice collecting hoppers of the modified ice collecting station of the apparatus of FIGS. 12 and 13.
Figure 15:
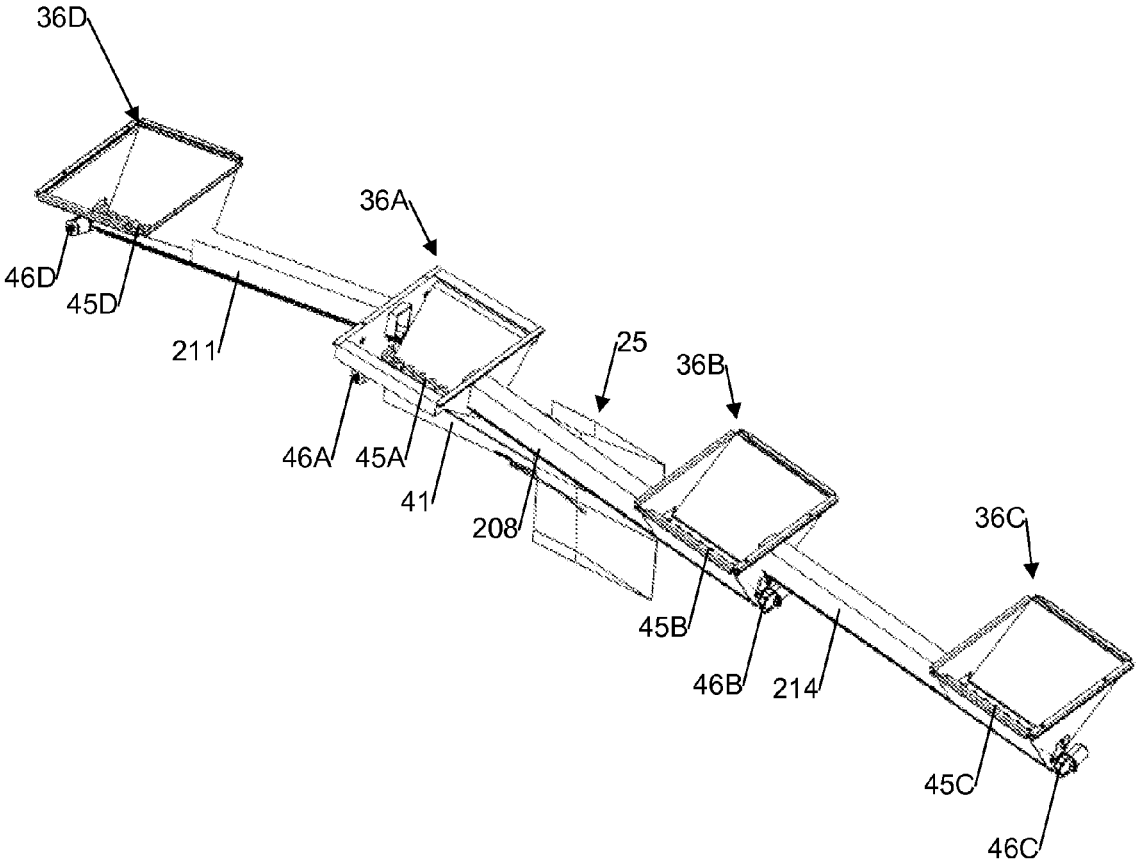
FIG. 15 is a perspective view of a modified embodiment in which the ice collecting station has four ice collecting hoppers.

As best illustrated in FIG. 14, the first or left hopper 36A is of a shape similar or identical to that of the first embodiment, and has a drive screw 45 extending through its lower region into feed chute 41. Drive motor 46 controls operation of the drive screw 45. As in the first embodiment, a drain channel 55 extends below the feed chute and melt water from the ice drains into channel 55 through openings (not visible) in the lower wall of chute 41. The end of feed chute is located between the two superimposed layers of the folded film 38 at the bag filling and sealing station, as in the previous embodiment.

The second or right hopper 36B is connected to an upper end portion of the first hopper 36A by a connecting chute 208 having an inlet 209 and an outlet 210. In the illustrated embodiment, feed chute 41 is inclined downwards while connecting chute 208 is inclined upwards, but both chutes may be horizontal in alternative embodiments. A second drive screw 45B extends through the lower end portion of hopper 36B and along connecting chute 208 so as to transport ice from the lower end of hopper 36B into hopper 36A. Drive screw 45B is driven by drive motor 46B.

In the embodiment of FIGS. 12 to 14, the system is doubled in size for greater capacity and bag filling speed. FIG. 10 shows an alternative embodiment of the invention in which there are two additional ice collecting hoppers 36C and 36D. Further ice makers may be provided above each of the additional hoppers (not shown). The third hopper 36C is located to the left of hopper 36A and has an ice transport chute 211 connected between the lower end of hopper 36C and the upper end of hopper 36A. A feed screw 45C extends through the lower end of hopper 36C and along transport chute 212 in order to convey ice into hopper 36A. The fourth hopper 36D is located to the right of hopper 36B and has an ice transport chute 214 connected between the lower end of hopper 36D and the upper end of hopper 36B. A feed screw 45D extends through the lower end of hopper 36D and along ice transport chute 214 to convey ice into hopper 36B. All ice is conveyed to and collected in the first ice collecting zone or hopper 36A before being conveyed to the ice bagging and sealing station 25 by the first ice transport screw 45 and dispensed into the bag. All ice collecting zones share the same ice bagging zone or station 25.

FIG. 16 is a functional block diagram of the components of the ice making, bagging and distributing apparatus of FIGS. 12 to 14. As illustrated in FIG. 16, the controller 92 receives sensor inputs from the door sensors 21 and the four storage compartment fill level sensors 20A, 20B, 20C, 20D. Each ice maker 12A, 12B has an ice maker sensor 33A and 33B, respectively, each of which has an output connected to controller 92. Ice maker sensors 33A, 33B detect water supply to the respective ice makers indicating that ice delivery to the hoppers can be expected within a certain time period (typically two to three minutes). As in the previous embodiment, the bag weight sensor 30 and bag seal position sensors 13, the film feed sensor 27 and film index sensor 29, and the film supply sensor 31 are also communicatively linked with controller 92. The bag transport and distributor station or apparatus 90 is also associated with several sensors 37A, 37B and 37C which are described in more detail below in connection with FIGS. 18 to 24, and these sensors are also communicatively linked with controller 92.

Figure 16A:
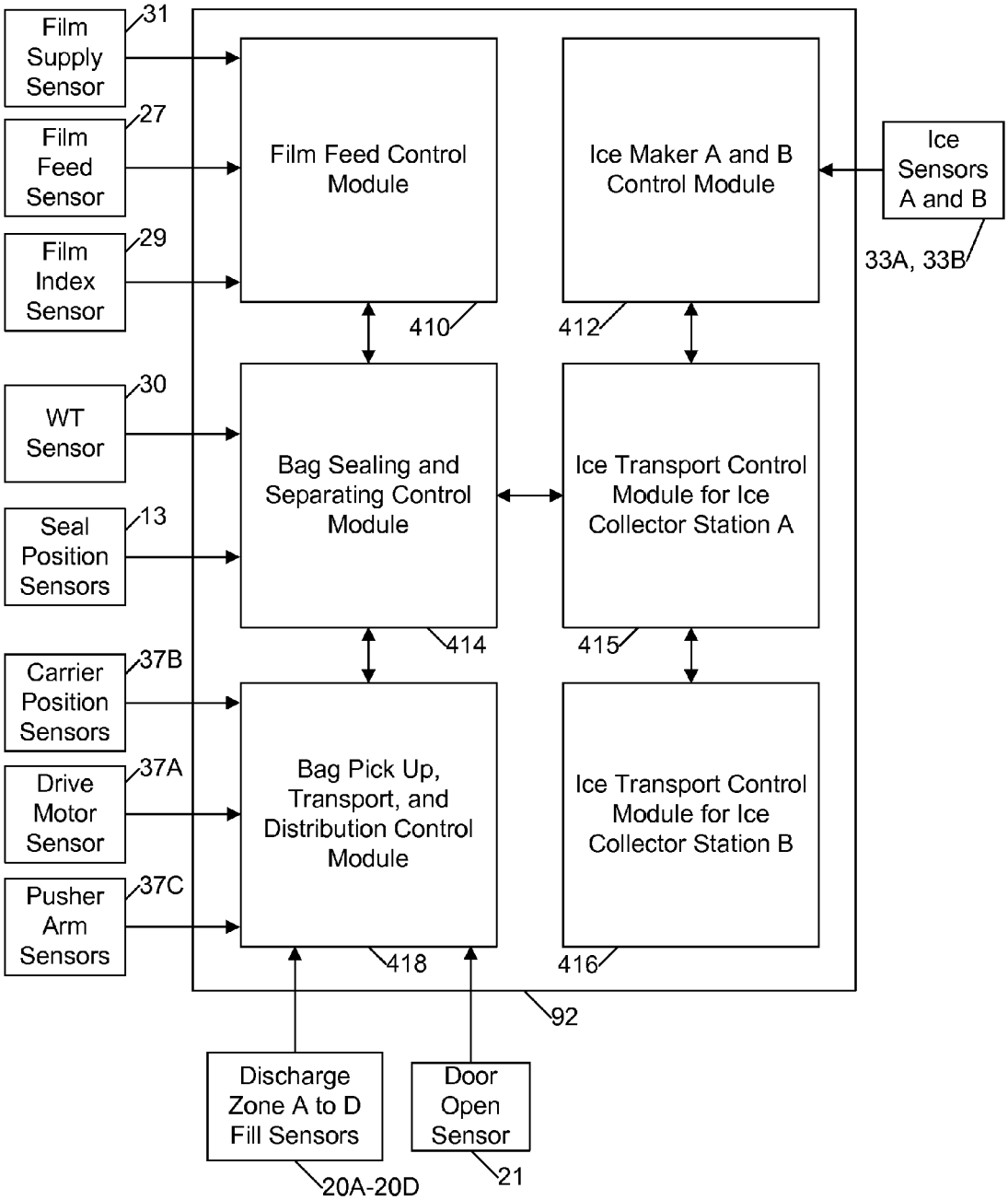
FIG. 16A is a more detailed functional block diagram of the controller of FIG. 16.

FIG. 16A is a functional block diagram illustrating one embodiment of the controller 92 of FIG. 16. As illustrated, controller 92 comprises a film feed control module 410, an ice maker control module 412 which controls ice makers 12A and 12B, a bag sealing and separating control module 414, an ice transport control module 415 for ice collector station 36A, an ice transport control module 416 for ice collector station 36B, and a bag pickup, transport and distribution control module 418 which controls the bag transport and distributor station 90.

The film feed control module 410 and bag sealing and separating control module 412 operate in much the same way as the equivalent modules of the previous embodiment. The ice maker control module 412 is communicatively linked with the ice sensors 33A and 33B and with other modules of the controller 92 in order to control ice making so as to maintain a required level of ice supply while saving power when possible. In one embodiment, the ice maker control module 412 may be arranged to shut off one of the ice makers when at least half of the storage compartment is full of bags of ice, and to turn on the second ice maker when the fill level is again below half. In this embodiment, the ice maker control module is also communicatively linked with the discharge zone fill sensors or the bag pick up, transport and distribution control module so as to monitor the fill level of the various storage zones 205A to 205D. This helps to conserve energy since the ice makers are turned on as needed.

The two ice transport control modules 415 and 416 are communicatively linked and cooperate to provide a continuous supply of ice to the bag sealing and separating control module when a partially formed bag is ready to receive ice and the required bag weight is not yet reached, and when there is still space in the storage compartment. The bag pick up, transport and discharge control module is communicatively linked with bag drive motor sensor 37A, bag carrier position sensors 37B, and pusher arm sensors 37C so as to control positioning of a bag carrier at a pick up position under the bag forming station, movement of the bag carrier to a selected discharge position, dispensing of the bag from the carrier into the storage compartment at the discharge position, and movement of the bag carrier back to the pick up position ready to pick up the next bag of ice when completed. This operation is described in more detail below with reference to FIGS. 18 to 26.

Figure 17:
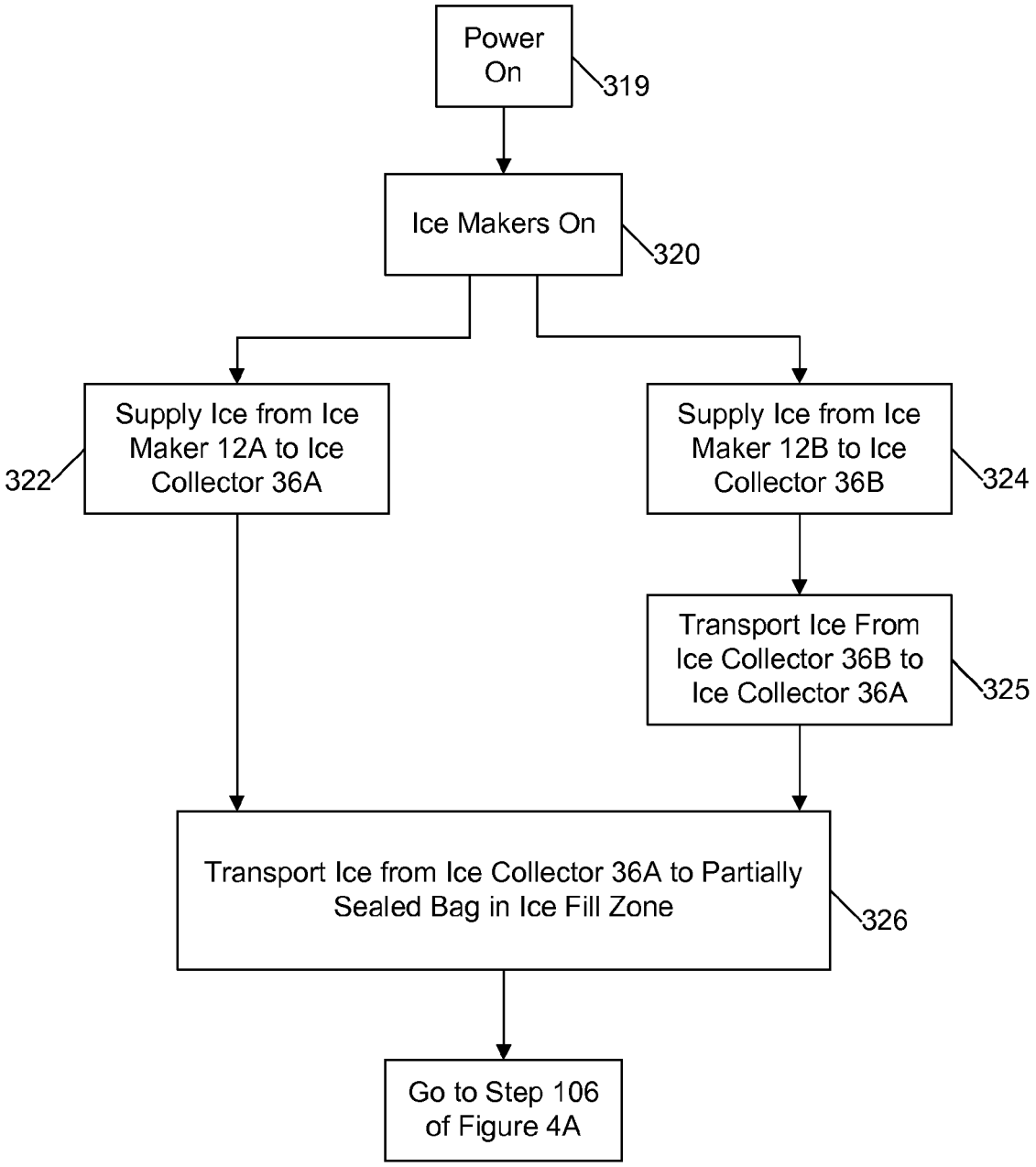
FIG. 17 is a flow diagram illustrating one embodiment of a method of supplying ice from the ice makers to the bag filling and sealing station in the apparatus of FIGS. 12 to 14 and 16.

FIG. 17 illustrates one embodiment of a method of operating the apparatus of FIGS. 12 to 14 and 16. Ice makers 12A and 12B are switched on at step 320 after the machine is switched on (319) and operated to supply ice alternately to hoppers 36A and 36B, with ice maker 12A supplying ice to ice collector or hopper 36A (step 322) and ice maker 12B subsequently supplying ice to ice collector or hopper 36B (step 324) while ice maker 36A makes more ice. Ice collected in hopper 36B is transported to hopper 36A (step 325), and ice accumulated in hopper 36A, whether originating from ice maker 12A or ice maker 12B and hopper 36B, or both, is transported from the ice collector to a partially sealed bag in the ice fill zone (step 326). In this way, ice does not sit in the hoppers for too long and the hopper 36A does not become over full. The process from this point on follows the same basic process steps as described above in connection with FIGS. 4A and 4B.

Ice may be transported from hopper 36B to 36A whenever ice is present in hopper 36B. The ice makers may be operated sequentially, with ice maker 12B turned on several minutes after ice maker 12A so as to maintain a continuous supply of ice. The ice makers are turned off when the ice storage compartment is sufficiently filled with bags of ice. When the ice maker is completely full, the controller proceeds to monitor the storage area periodically to determine when more bags of ice are needed, and then re-activates the ice making, bagging, and distributing stations as needed.

FIGS. 18 to 24 illustrate one embodiment of the bag transport and distributor station or apparatus 90. The apparatus 90 has a horizontal guide frame 215 which is suspended from the lower part of the retrofit unit 200 by suitable support posts, as illustrated in FIG. 13, and may also or alternatively be secured to the frame or housing of the storage compartment. In the latter case, the retrofit method described above also includes the step of securing the frame 215 to the storage compartment wall via suitable fasteners. A bag conveyor 218 is movably mounted on frame 215. In the illustrated embodiment, the conveyor comprises a pair of endless chains 220 extending around guide wheels 219, 221 on opposite sides of the guide frame between the opposite ends of the frame, and a slide or bag carrier 216 secured between opposite links of the chains 220 via adapters 222. The two chain links are disposed diagonally opposite each other. A conveyor drive motor 230 is connected with the driving sprocket wheels 219. The horizontal slide or bag carrier 216 is longitudinally displaceable relative to guide frame 215 so that it may distribute articles such as bags of ice 206 into the discharge or bag storage areas 205A, 205B, 205C and 207D.

Figure 18:
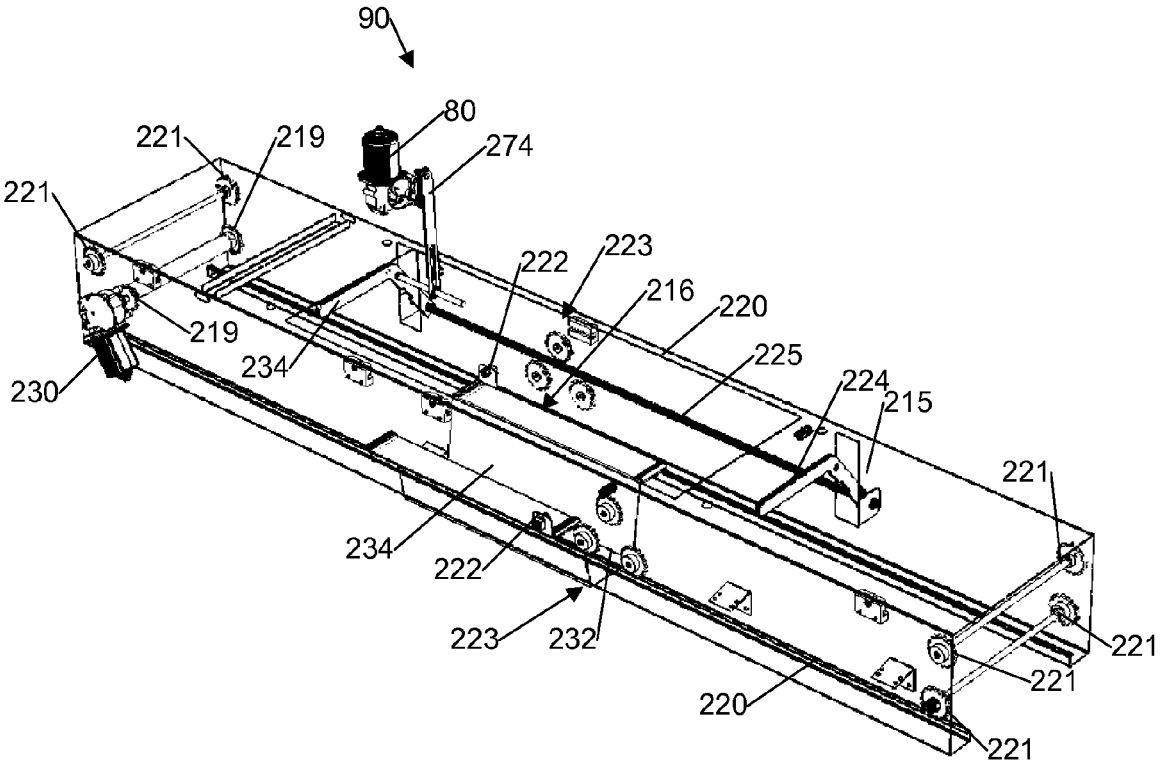
FIG. 18 is a right perspective view illustrating one embodiment of the bag transport and distributing unit of the apparatus of FIGS. 12 to 14 and 16.
Figure 19:
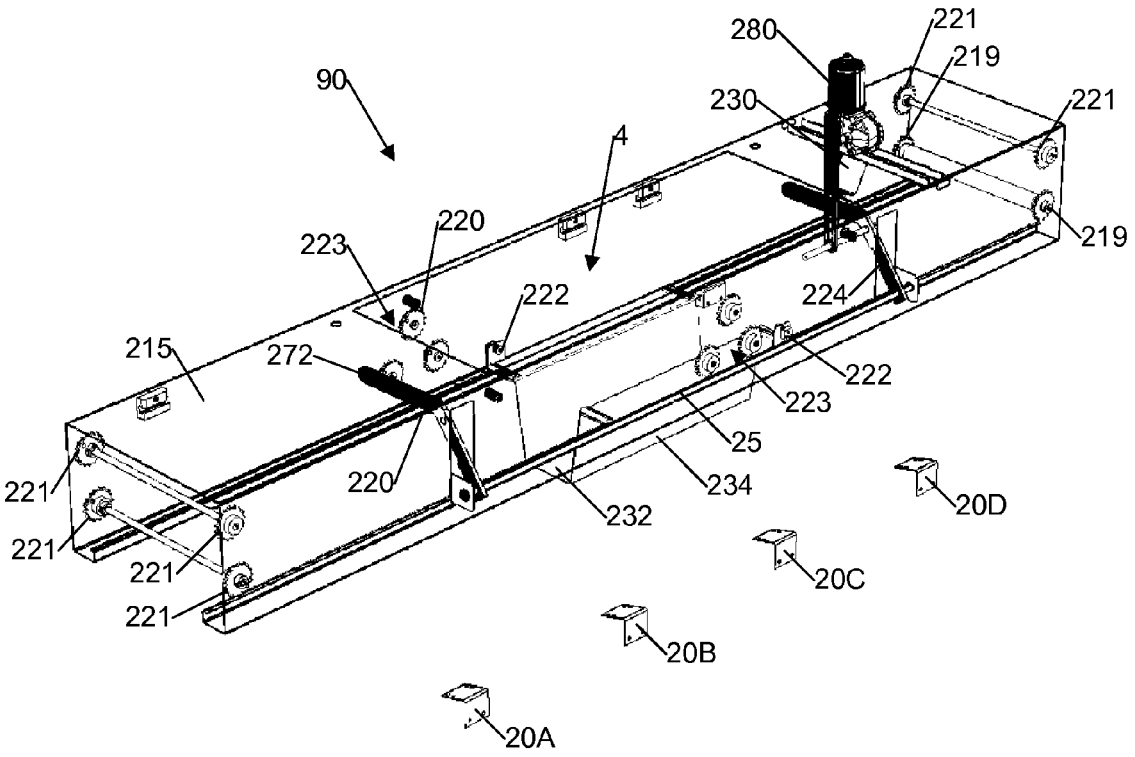
FIG. 19 is a left perspective view of the bag transport and distributing unit of FIG. 18.
Figure 23:
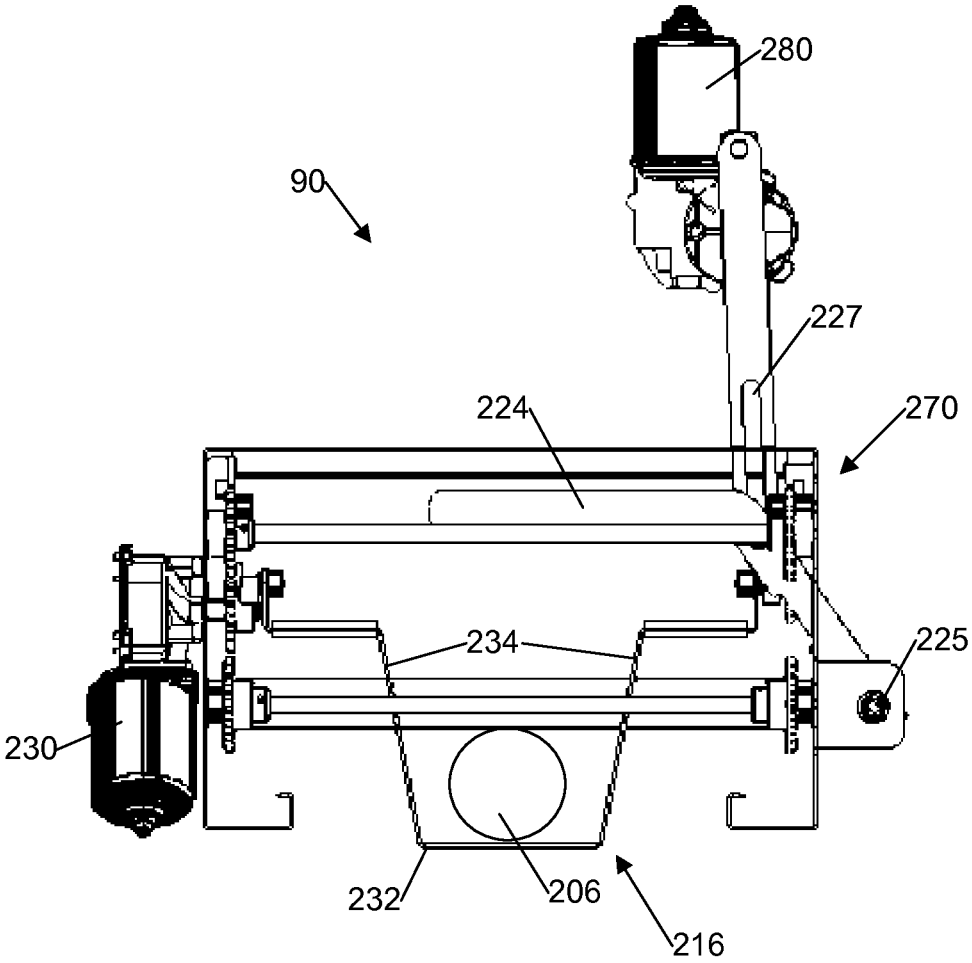
FIG. 23 is an end elevation view of the bag transport and distributing unit with a bag positioned on the carrier during transport and the pusher arm in a raised position.

As best illustrated in FIGS. 18, 19 and 23, the carrier or slide 216 is generally U-shaped in cross-section, having a lower support surface 232 and opposite angled side walls 234, and is open at its opposite longitudinal ends with free edges 212, 213 (see FIG. 20A) A bag 206 can be pushed off the carrier over these edges, as described in more detail below. Although the slide or carrier 216 has a U-shaped cross-section in the illustrated embodiment, other cross-sections may also be used. The advantage of the U-shaped cross-section is that bags 206 only can leave the slide over the edges at each end.

Figure 21:
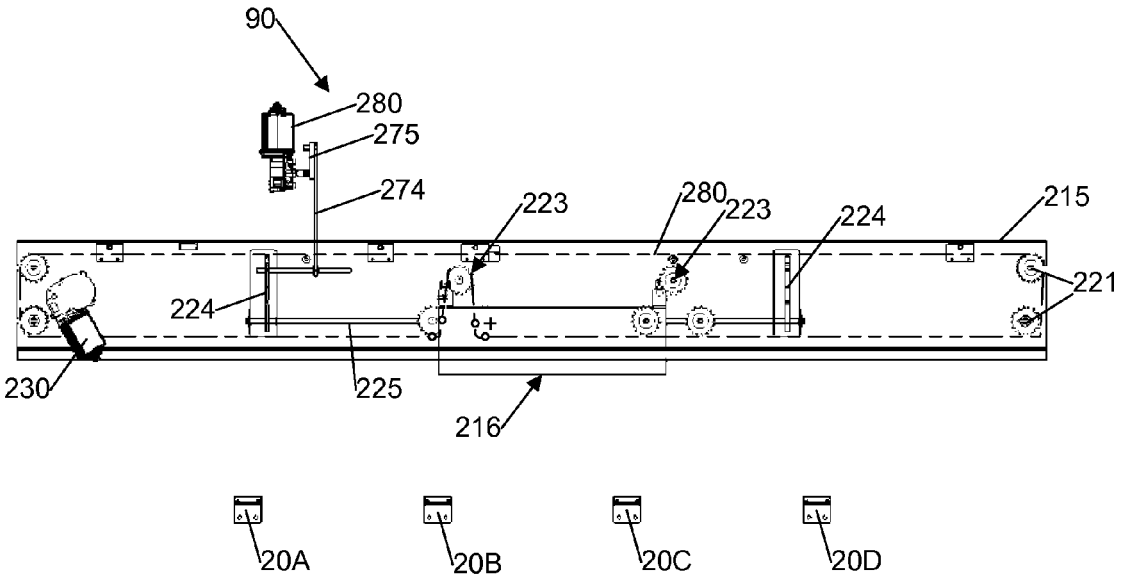
FIG. 21 is a front elevation view of the transport and distributing unit illustrating the carrier in a raised position to support a bag during sealing and separating the upper end of the bag.
Figure 22:
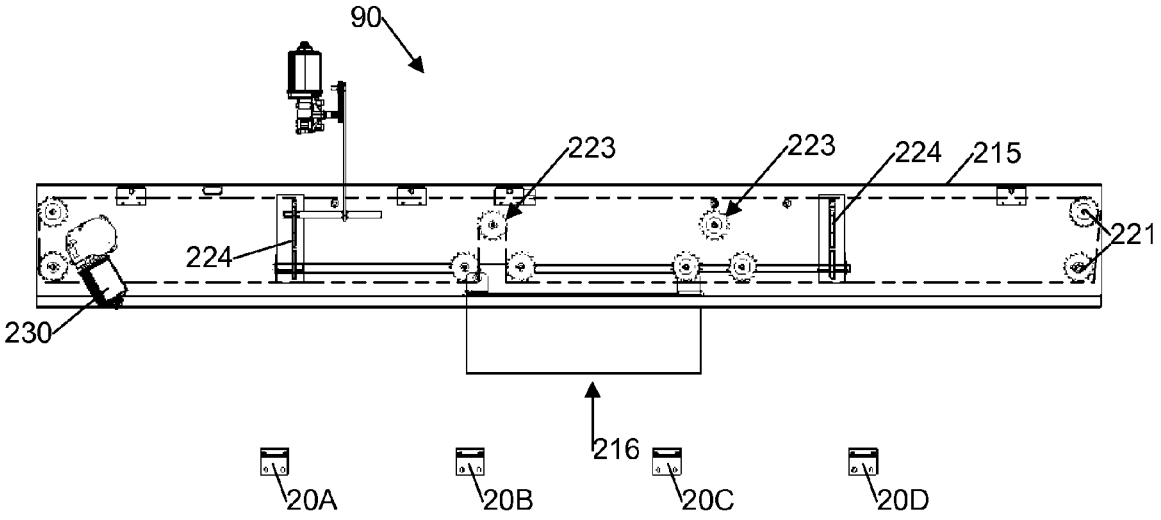
FIG. 22 is a front elevation view similar to FIG. 21 illustrating the transport and distributing unit with the carrier in a lowered position after a bag has been separated from the welding station and dropped onto the carrier, ready for movement to a selected discharge position.
Figure 24:
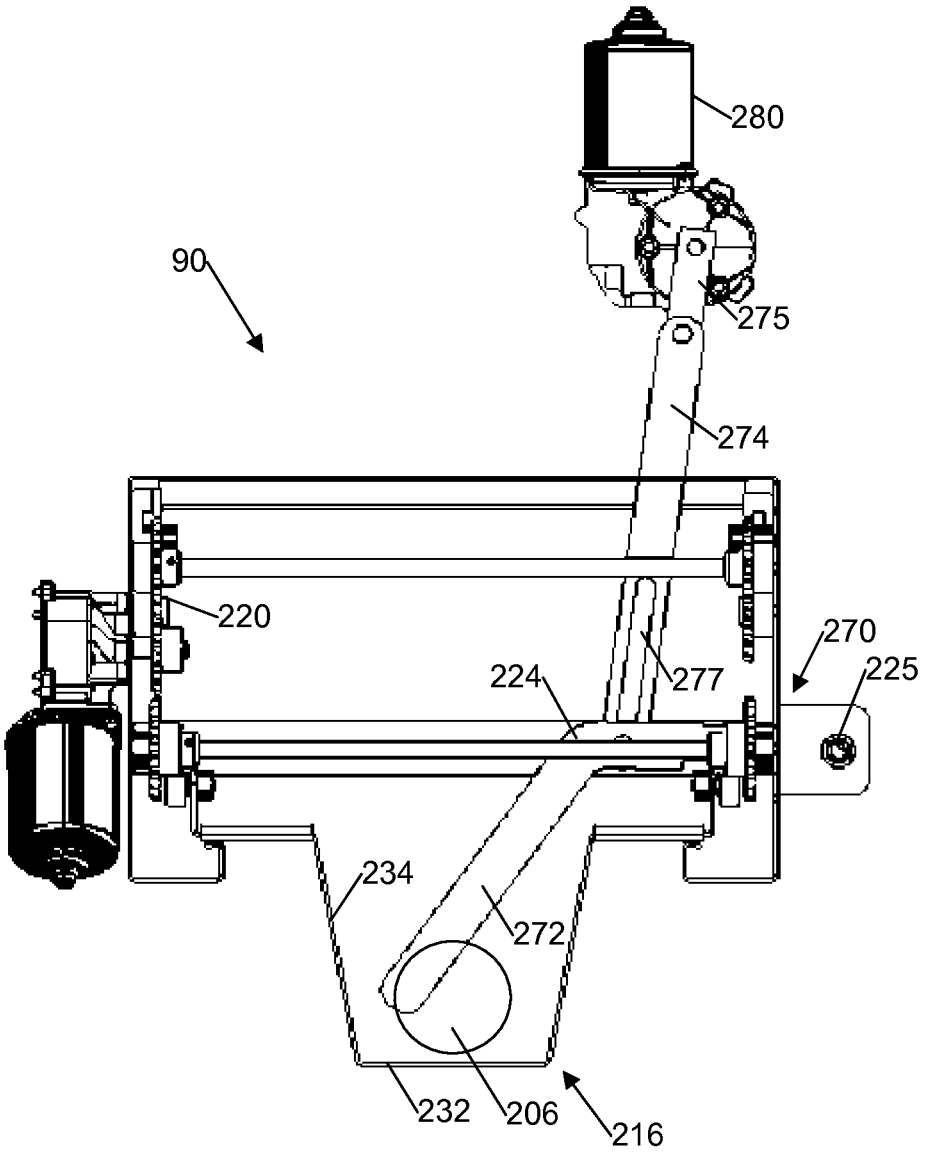
FIG. 24 is an end elevation view similar to FIG. 23 illustrating the pusher arm in a lowered position for pushing the bag off the edge of the carrier.

The conveyor mechanism is vertically displaceable as the chain 20 runs around three middle sprocket wheels 223 at each side. The slide 216 is elevated from a second height as seen in FIGS. 22 and 24 to a first, raised height as seen in FIGS. 21 and 23 during passage over the three middle sprocket wheels 223. The sprocket wheels 223 are positioned so that the slide is elevated when positioned in a pick up position under the bag making and ice filling station 25. By elevating the bag support surface 232 in this position on the conveyor, the suspended bag is fully supported and the film web tension is relieved, to reduce the risk of a bag being separated before welding is complete, and also so that the line of separation when the bag is separated or cut can be made straight or substantially straight. In the illustrated embodiment, the same drive motor 230 provides the drive for longitudinal displacement of the carrier or slide as well as vertical displacement of the support surface 232 of the carrier. The carrier may be positioned out of alignment with the bag making and ice filling zone during dispensing of ice into a bag. Once the correct bag weight is reached, the film feed motor may be reversed to lift the bag clear of the carrier travel path, after which the carrier is moved into the aligned position and raised into the elevated position by the middle sprocket wheels. The film feed drive motor is then reversed to position the upper end of the bag in the welding zone, while the lower end is supported on the support surface 232. Once the bag is welded and separated from the remainder of the film in the bag making zone, the carrier is driven in a selected direction along the frame, and lowered into the travel and dispensing position of FIG. 24.

Figure 20A:
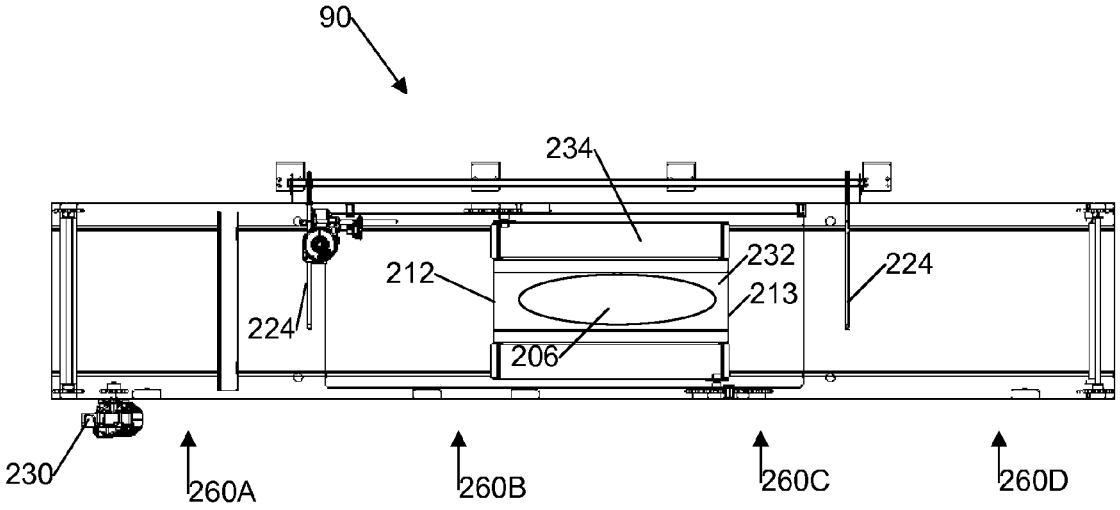
FIG. 20A is a top plan view of the bag transport and distributing unit of FIGS. 18 and 19, illustrating a bag of ice positioned on a slidably mounted carrier in a first position in the unit.

The conveyor and distributor station in this embodiment has four possible discharge zones 260A, 260B, 260C and 260D, which are positioned above storage areas 205A, 205B, 205C, and 205D, respectively, of the storage compartment/merchandiser, as illustrated in FIGS. 13 and 20A. In the illustrated embodiment, a pusher mechanism 270 is mounted on the frame 15 for pushing bags 206 off the carrier 216 into a selected discharge zone. Pusher mechanism 270 comprises a rotatable shaft 225 which is rotatably mounted in a lower portion of one side of the frame, and a pair of pusher arms 224 each having one end mounted at each end of the shaft 225 for rotation between a raised, retracted position out of the path of the carrier, as illustrated in FIG. 23, and a lowered position in which an angled end portion 272 of the pusher arm is disposed in the path of a bag carried on the carrier or slide 216, as illustrated in FIG. 24. The pusher arms 224 are driven between the retracted position and the lowered, operative position by a drive motor 280 which is connected to one of the pusher arms by pivotal connecting link 274 pivotally connected to the end of crank shaft 275 at one end and to the angled portion of one of the pusher arms 224 at the other end via pin 276 which extends from the pusher arm 224 through the slot 277 in link 274. As the crank shaft 275 rotates with the motor drive shaft, the connecting link 274 is moved from the position shown in FIG. 23 to the position shown in FIG. 24, simultaneously driving the pusher arm down to the operative position of FIG. 24.

FIG. 19 illustrates the location of the level sensors 20A to 20D mounted in the storage compartment as indicated in FIG. 13 relative to the four discharge areas 260A to 260D of the conveyor and distributor apparatus. In the illustrated embodiment, there are four discharge areas and four bag level sensors, however a greater number of discharge areas may be provided in alternative embodiments, depending on the size of the storage/freezer compartment or merchandiser 204. In each case, level sensors are provided in a number corresponding to the number of discharge areas. Position sensors or proximity switches 37B (FIG. 16) are positioned on the frame 215 to detect right and left end positions of the conveyor carrier to limit movement of the carrier against the left and right ends of frame 215, as well as for detecting the waiting or pick up position of the conveyor and the raised support position of the conveyor carrier where it supports a lower end of a bag before the bag is cut or separated from the next bag. Additional proximity switches 37C detect when the stopper or pusher arm 224 is in the raised, refracted position and the lowered, operative position. A Hall sensor or the like 37A is also associated with the conveyor motor 230 to detect movement of the conveyor carrier so as to determine when the carrier 216 is in selected discharge positions.

FIGS. 20A to 20G illustrate different sequences of movement of the conveyor driven carrier 216 to dispense bags 206 of ice to different regions of the storage compartment or merchandiser 204, as controlled by the pick up, transport and distribution control module 418 of FIG. 16A. In the illustrated example, bag discharge in discharge areas 260C and 260D is illustrated, from which those skilled in the field can determine the discharge sequence for discharging bags in the left hand side discharge areas 260A and 260B using the other pusher arm 224.

Figure 20B:
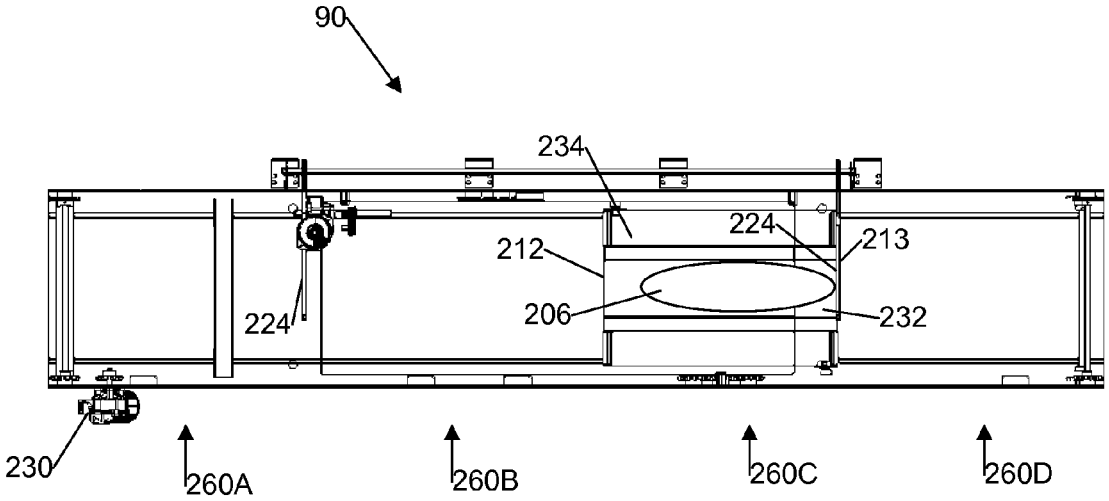
FIG. 20B is a top plan view illustrating a second position of the carrier with the bag of ice contacting a pusher arm.
Figure 20C:
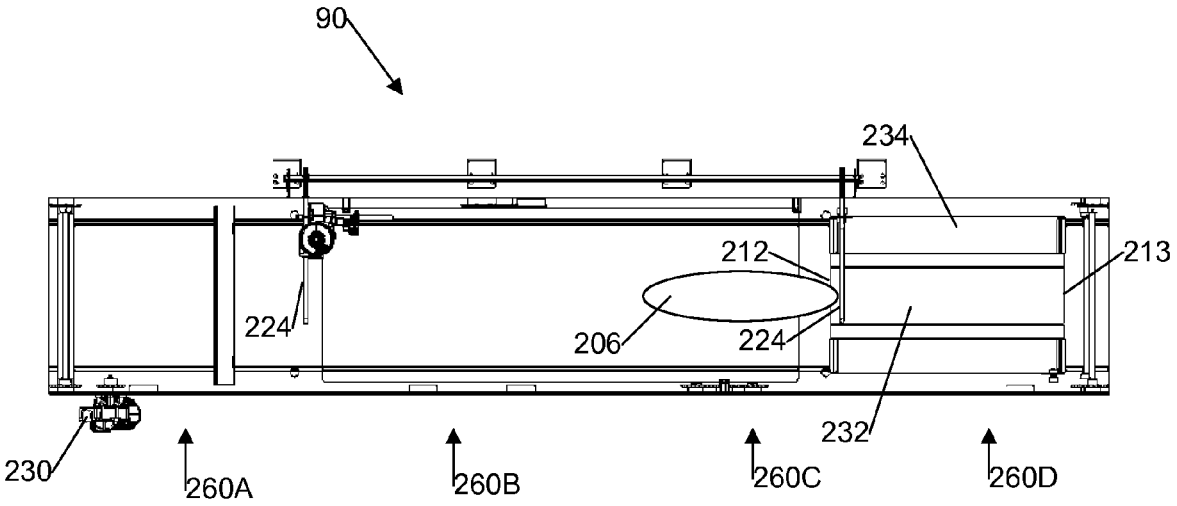
FIG. 20C illustrates a subsequent stage where the carrier has traveled to the right with the bag of ice held in position by the pusher arm.

FIG. 20A illustrates a start position in which a bag of ice 206 is disposed on the support surface 232 of the carrier or slide 216. In FIG. 20B the carrier is driven to the right by the conveyor mechanism, into a position over the discharge area 260C, as detected by either a conveyor position sensor or motor sensor 37A. At the same time, the pusher arm 224 is lowered into the path of the bag 206, as seen in FIG. 24. In FIG. 20B, the bag has just come into contact with the end portion 272 of the pusher arm. Displacement of the carrier to the right is continued on from this point, while the pusher arm pushes the bag to the left and over the left hand end 212 of the support surface 232. This is illustrated in FIG. 20C, where the bag 206 is about to fall off the carrier and into the storage area 205C of the merchandiser.

Figure 20D:
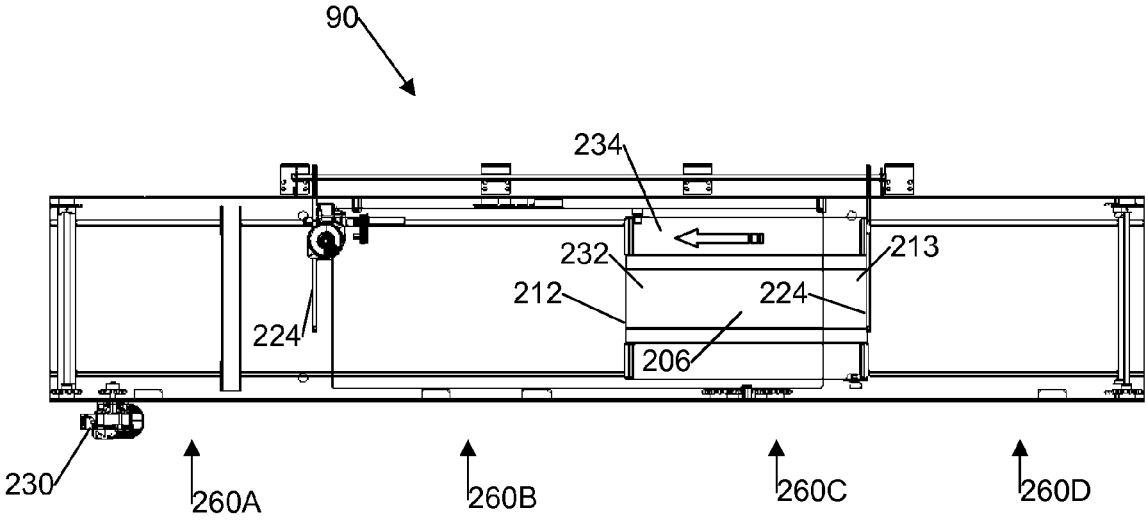
FIG. 20D illustrates a subsequent stage of the distribution where the ice has been pushed off the edge of the carrier to fall through the discharge opening into the storage compartment, and the carrier is driven back in the opposite direction to pick up another bag of ice.

After the bag is dropped off the slide or carrier 216, the motor 230 is reversed to move the slide back to the initial position for collecting the next bag of ice, as illustrated in FIG. 20D. Once the next bag of ice is collected, the foregoing steps are repeated with appropriate selection of discharge area 260A, 260B, 260C, or 260D by controller 92 in a controlled sequence.

Figure 20E:
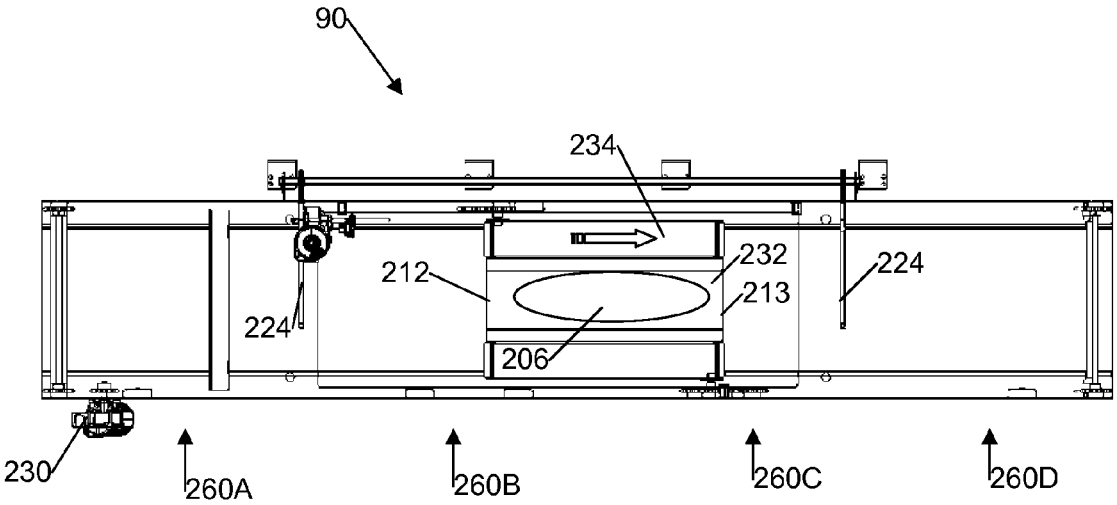
FIG. 20E illustrates another bag of ice supported on the carrier while the carrier is moving into position above another discharge area.
Figure 20F:
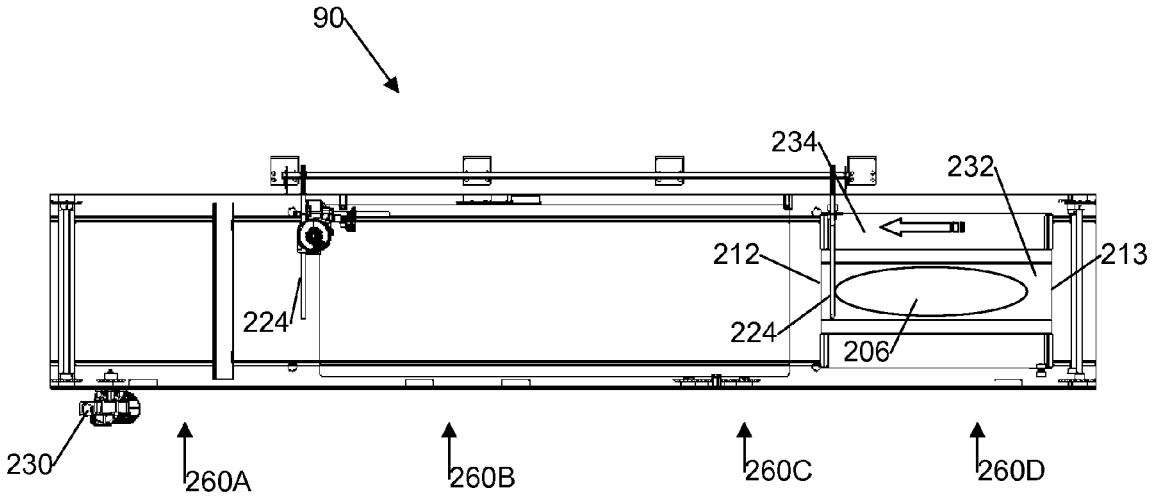
FIG. 20F illustrates the carrier positioned over a different discharge area prior to moving back towards the pick up area, while the bag of ice is held in position by the pusher arm.
Figure 20G:
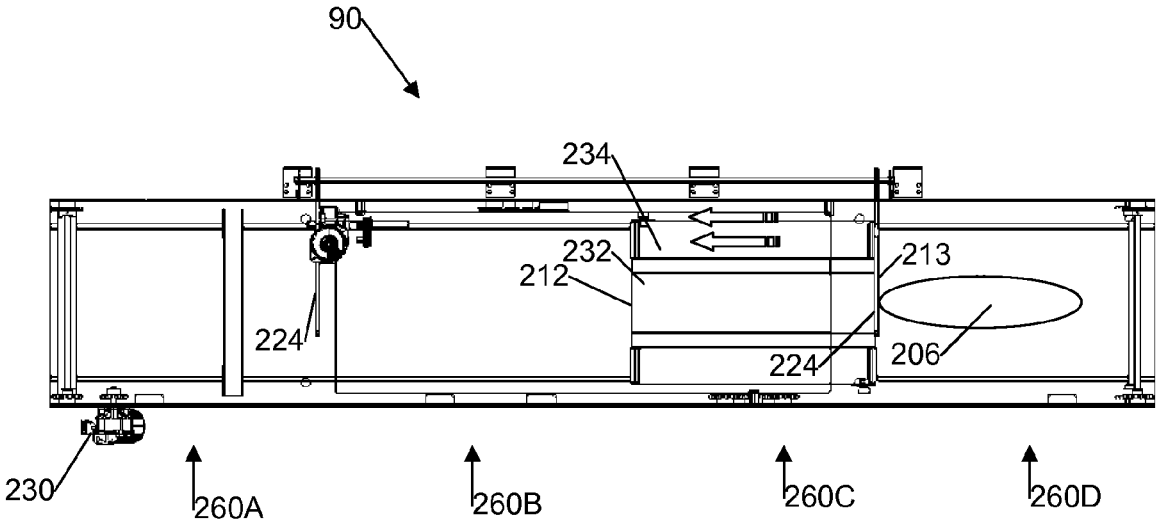
FIG. 20G illustrates the bag in the process of being pushed off the edge of the carrier as the carrier moves back to the pick up area.

In FIG. 20E, the next bag 206 is positioned on the slide while the slide is driven in the direction of the arrow towards discharge area 260D. Pusher arm 224 is in the raised position of FIG. 23 while the slide is moved to area 260D, out of the path of the bag 206. In FIG. 20F, the slide 216 has reached discharge area 260D and the pusher arm 224 is now positioned adjacent the left hand end 212 of the slide. In this position, the pusher arm 224 is lowered into the path of the bag, and the conveyor motor is reversed to drive the slide or carrier 216 back in the opposite direction, as indicated by the arrow in FIG. 20F. In FIG. 20F, bag 206 has just contacted the lowered arm 224. In FIG. 20G, the travel of the carrier 216 back to the bag pickup area is continued. At the same time, the bag 206 is prevented from traveling with the carrier 216 by the arm 224 engaging its right hand end, and is pushed by the arm 224 to the right, until it is discharged over the other edge 213 of the slide or carrier into the discharge area 260D, while the carrier continues back to the start position to pick up the next bag.

Figure 25:
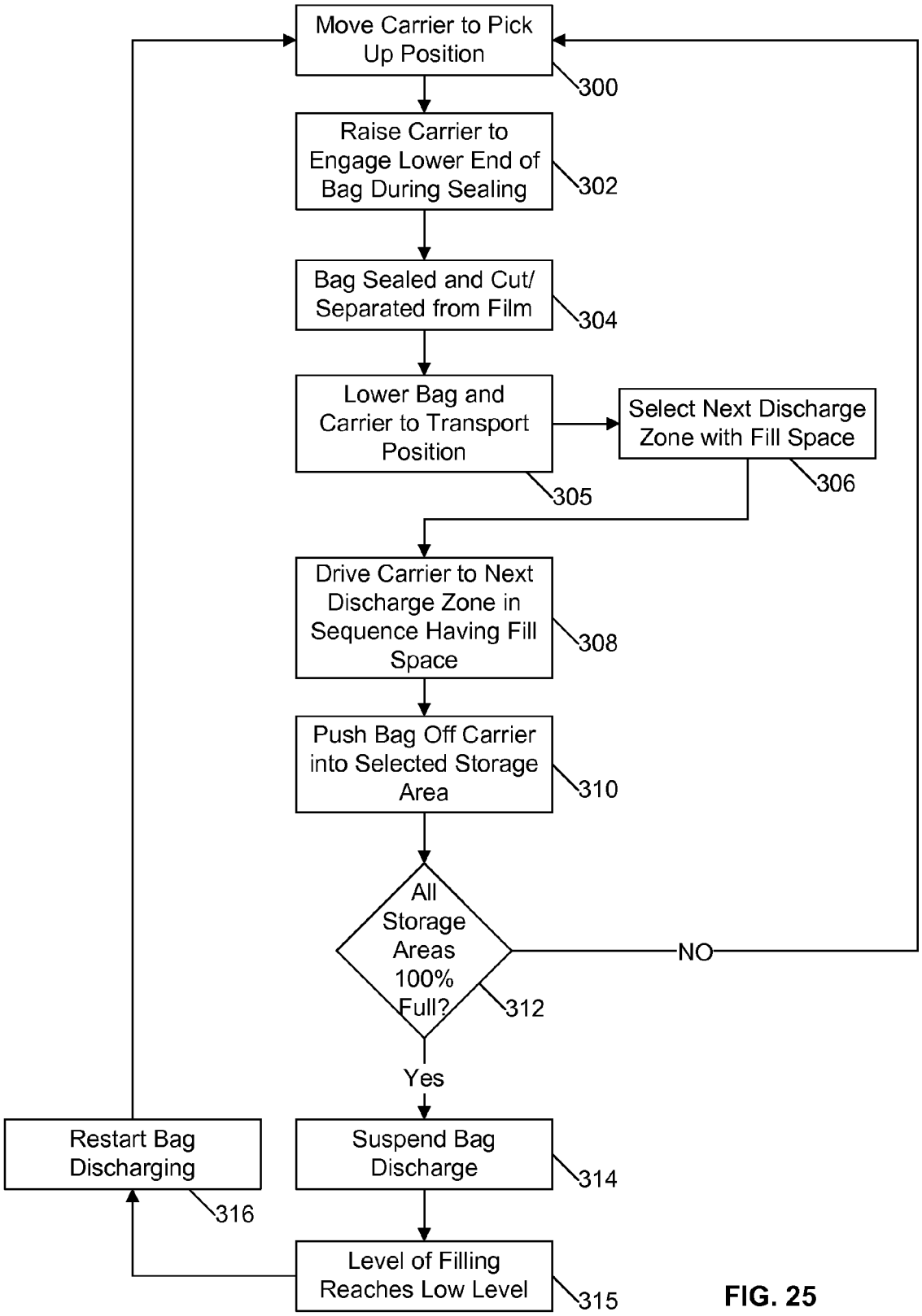
FIG. 25 is a flow diagram illustrating one embodiment of a method of controlling the bagged ice transport and distributing unit of FIGS. 18 to 24 to distribute bags of ice to different storage zones of the ice bag storage compartment of FIGS. 13 and 16.

FIG. 25 is a flow diagram of one embodiment of a method for distributing bags using a conveying and distributing apparatus as illustrated in FIGS. 18 to 20 in conjunction with the other stations of the ice making, bagging and dispensing machine of FIGS. 12 to 16 when the apparatus is switched on. In step 300, the conveyor slide or carrier 216 is moved into the pick up position, and is then raised into the upper position to engage the lower end of a bag suspended into the storage and freezer compartment (step 302). After the sealed bag is cut or otherwise separated from the remainder of the film in the bag making zone (step 304), the bag and carrier are lowered into the transport position (step 305). In step 306, the controller determines which discharge zone is next in a predetermined discharge or bag distribution sequence and whether that zone has fill space. If there is still room in that storage area, the carrier is driven to the selected discharge zone (step 308) while the pusher arm is positioned to push the bag off the carrier or slide support surface, after which the carrier is driven in the appropriate direction for the bag to be pushed off the opposite end edge of the support surface, as described above in connection with FIGS. 20A to 20G (step 310).

If all storage areas are full at step 312, bag discharge is suspended (step 314) until the level of filling in one or more storage areas has fallen to a low value (step 315) as determined by appropriate fill level sensors, after which the bag discharging process is re-started (step 316). During this process, the controller monitors inputs from the proximity sensors 37B and pusher arm sensors 37C to control the conveyor and pusher arm drive motors appropriately. The controller also monitors the door sensor 21 to stop distribution of bags into the storage area while the door is open. Once the door is again closed, the conveyor and distributor apparatus is restarted. If the door remains open for more than a predetermined time interval, store personnel are notified or maintenance staff are alerted, or an alarm may be sounded.

Figure 26:
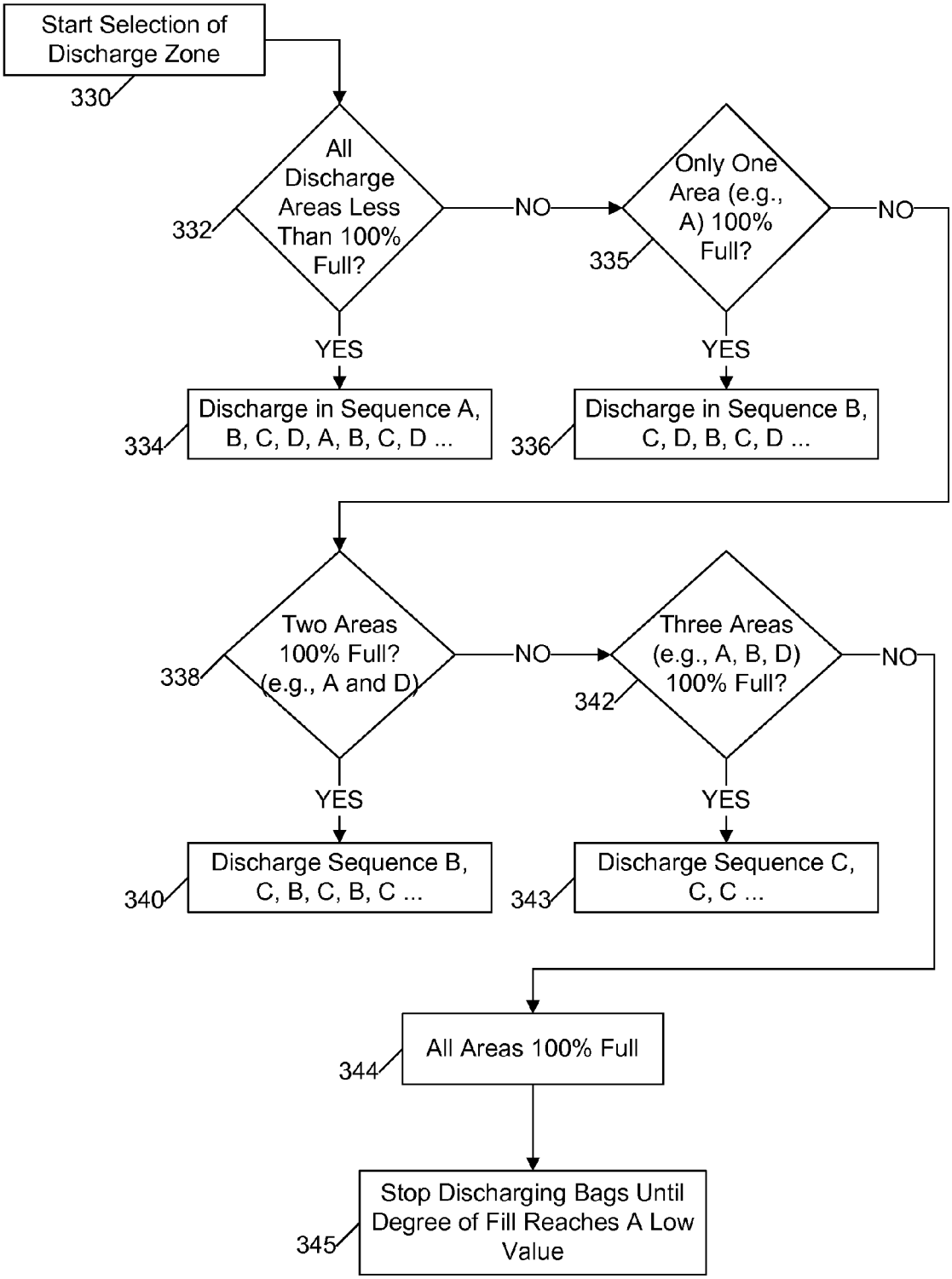
FIG. 26 is a flow diagram illustrating one embodiment of a method of selecting a bag discharge sequence to be used in the method of FIG. 25.

FIG. 26 illustrates one possible embodiment for selecting a discharge sequence with the above apparatus, for example in step 306 of FIG. 25. After the selection process is started (step 330), the controller first determines whether all discharge areas are less than 100% full (step 332). If so, the discharge follows the sequence A, B, C, D, A, B, C, D . . . and so on (step 334). If not all discharge areas are less than 100% full, the controller determines if only one area is 100% full, and which area is 100% full, in step 335. In the example of FIG. 26, area A is the area which is 100% full, but this could alternatively be any of the areas B, C, or D. If area A is 100% full, the discharge sequence successively supplies bags to all the areas in sequence except for area A, i.e. areas B, C, D, B, C, D, and so on (Step 336). If two areas (e.g. areas A and D) are 100% full and the others are less than 100% full (step 338), the discharge sequence is B, C, B, C, and so on (step 340). Finally, if three areas (e.g. A, B and D) are 100% full and only one area (in this case area C) is less than 100% full (step 342), then the discharge sequence is C, C, C, . . . and so on (step 343). Once all areas are 100% full (step 344), discharge of bags from distributor 90 is suspended (step 345) until the degree of fill again reaches a low level. The advantage of this technique is that a level distribution of bags of ice tends to be produced and maintained in the storage compartment. When one or more users take bags of ice from the storage compartment, the degree of filling in the discharge areas may be different due to the fact that the bags of ice are taken from the discharge areas at different rates. By actively detecting the degree of filling in the individual discharge areas and adapting the sequence of selecting discharge area on the basis of a comparison of the degrees of filling in each discharge area, a leveling of the height of the stacks of ice bags in the various areas can be achieved that takes into account users randomly taking bags from the various areas.

FIG. 26 illustrates an alternative embodiment of a conveying and distributing apparatus 290 in which bags 206 are dropped onto an endless conveyor belt 292 having opposite side edges 293, 294 in parallel with the direction of movement of the conveyor. In this embodiment, a pusher arm 295 which is oblique relative to the direction of movement of the conveyor is movably mounted above the belt and is lowered into contact with the belt at a desired location for pushing bags 206 off the opposite sides 293, 294 of the belt into opposite discharge areas 296A and 296B. Bags are pushed over the opposite free edges of the conveyor belt depending on its direction of movement, as indicated in FIG. 26. This embodiment is particularly suitable for dispensing bags of ice into relatively wide storage compartments as the discharge areas are laid out in two rows, one at each side of the conveyor belt 292, while the previous embodiment is suitable for a relatively narrow, elongate storage compartment.

In the above embodiments, a controller or control system is operatively linked with all of the various stations, including the ice maker, ice transport, film feed, bag forming station, and bag conveying and discharging station. However, individual controllers may alternatively be associated with at least some stations or parts of the apparatus. The controller or controllers can be based on an electronic circuit which may be programmable. Alternatively, the controller can be a pure mechanical control which may be established by a hydraulic or pneumatic circuit.

Monitoring of the degree of filling in various zones or areas of the storage and freezer compartment may also be utilized for controlling ice making and bagging. For example, where the apparatus has two ice makers as in FIGS. 12 to 16, one of the ice makers may be shut off when the filling degree in half of the discharge areas reach 100%, and may be turned on again when the filling degree falls back to a lower level. This controls the production such that efficiency is increased and idling time is reduced. This procedure also reduces energy consumption and may increase service lifetime of the apparatus.

During filling of a film bag in the above embodiments, the partially formed bag hangs freely in the machine such that it is possible to fill the film bag to a given weight which is measured by a weighing cell. Then the conveyor is lifted to a first height, whereby support of the bag is gradually taken over by the conveyor until the former is fully supported on the support face of the conveyor. The film web is now fully relieved and not influenced by tensile forces induced by the weight of the filled film bag. This can produce improved bag welding or sealing, since severing the film web by melting before establishing the necessary weld seams is avoided. A loaded film web is deformed in direction of the tensile forces when melting under the action of the welding jaws such that the film bag may be inadvertently released from the film web. This arrangement also produces a straighter separation or cut line between adjacent bags.

In the embodiment of FIGS. 18 to 24, the drive mechanism for raising the conveyor carrier is a series of raised sprocket wheels over which the drive chain, and thus the carrier attached to the chain, is driven. However, other lifting devices may be used for the vertical displacement in alternative embodiments, such as a linear actuator in the form of a hydraulic or pneumatic cylinder connected with the suspension points of the conveyor, a parallelogram device, or other types of guide for guiding the conveyor during the vertical displacement. Where the conveyor includes a slide or carrier connected with an endless conveyor in the form of a chain provided with a path formed by a number of sprocket wheels, the path is arranged with sprocket wheels at different levels and distances so that the conveyor is displaced in height at the initial position for placing the bags, and is displaced in longitudinal direction towards the discharge positions. This arrangement combines longitudinal displaceability with vertical displaceability of the conveyor by means of the same construction element in the apparatus so that the same drive means is used for both longitudinal displacement and vertical displacement. In the case of a conveyor belt as in FIG. 27, the conveyor belt may also be driven over vertically displaced guides to be raised in the pick up position to support the lower end of a bag.

The retrofit apparatus and method of the above embodiments allows ice cubes, pieces or other forms of particulate ice such as ice shavings to be supplied to a partially formed bag as the bag is being made, reducing the expense of using pre-made bags. The use of drive springs to convey ice from the collector or hopper to the partially formed bag is advantageous since it helps to break up large clumps of ice formed when ice cubes become frozen together due to ice melt and re-freezing. Any jams against the exit side of the hopper as a result of such large clumps result in compression of the spring which bears against the large clump and tends to break it up into smaller pieces. A continuous spring is also easier to clean and more hygienic than known drive screws or augers. The use of a drive spring along with the drain openings in the drive chute which communicate with a downwardly inclined drain channel also helps to remove melt water from the ice as it is conveyed into a bag.

The ice making, bagging, and dispensing apparatus of the above embodiments may be provided as a stand-alone unit with an integral freezer and storage compartment. Alternatively, a separate retrofit ice making and bagging unit may be provided for retrofit installation on top of an existing bagged ice merchandiser or aisle freezer in a store. Such merchandisers are often stocked with bagged ice manually by store personnel, which is time consuming and expensive. An automatic system which makes ice and bags, supplies ice to the bags, and supplies bagged ice to the freezer and storage compartment is much faster and more convenient than manual filling of bags and placing of filled bags into to the freezer. In a retrofit installation method, the top of the existing merchandiser may be removed to allow installation of the ice making, collecting, and bagging unit on top of the merchandiser or aisle freezer unit. This allows on-site ice production without installing specialized aisle equipment.

Those of skill in the art will appreciate that the various illustrative logical blocks, modules, circuits, and method steps described in connection with the above described figures and the embodiments disclosed herein can often be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled persons can implement the described functionality in varying ways for each particular application, but such implementation decisions should not be interpreted as causing a departure from the scope of the invention. In addition, the grouping of functions within a module, block, circuit or step is for ease of description. Specific functions or steps can be moved from one module, block or circuit to another without departing from the invention.

Moreover, the various illustrative logical blocks, modules, and methods described in connection with the embodiments disclosed herein can be implemented or performed with a general purpose processor, a digital signal processor ("DSP"), an ASIC, FPGA or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine and the processing can be performed on a single piece of hardware or distributed across multiple servers or running on multiple computers that are housed in a local area or dispersed across different geographic locations. A processor can also be implemented as a combination of computing devices, for example, a combination of a DSP and a microprocessor, a plurality of microprocessors, one or more microprocessors in conjunction with a DSP core, or any other such configuration.

Additionally, the steps of a method or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of storage medium including a network storage medium. An exemplary storage medium can be coupled to the processor such the processor can read information from, and write information to, the storage medium. In the alternative, the storage medium can be integral to the processor. The processor and the storage medium can also reside in an ASIC.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A retrofit ice making and bagging apparatus for installation on an existing aisle freezer, comprising:

an outer housing having a lower end of predetermined shape and dimensions configured for securing on top of the existing aisle freezer, the outer housing having a lower end which is at least partially open to provide a passageway into a freezer compartment through an opening in an upper end of the existing aisle freezer;

an ice making unit mounted in the outer housing and having an ice outlet through which pieces of ice are dispensed; and a bag making and filling station located above the lower end of the outer housing and including a bag forming device which is configured to receive film material from a film supply and form film material into bags, the bag forming device having an inlet which directs ice from the ice making unit into a partially formed bag, and a bag sealing and separating device adapted to seal a bag containing ice and separate the bag from the supply of film material supplied to the bag forming device, the bag sealing and separating device communicating with the passageway whereby bags of ice fall into the freezer compartment when separated from the bag sealing and separating device.

2. The apparatus of claim 1, further comprising an ice collecting station positioned in the outer housing to collect ice from the ice outlet and an ice transport device mounted in the outer housing, the ice transport device adapted to transport ice from the ice collecting station into a partially formed bag at the bag making and filling station.

3. The apparatus of claim 2, further comprising an ice transport control module which controls transport of ice from the ice collecting station to the bag making and filling station when a bag is partially formed and ready to receive ice.

4. The apparatus of claim 2, wherein the ice collecting station comprises a hopper having an open upper end which receives ice and a lower end, and a transport chute extends from the lower end of the hopper and has an exit end located in the bag making and filling station which comprises the inlet of the bag forming device, and the ice transport device extends through the lower end of the hopper and along at least part of the transport chute.

5. The apparatus of claim 4, wherein the ice transport device comprises a drive spring and a drive motor which rotates the spring.

6. The apparatus of claim 4, further comprising a drain channel extending under the transport chute and having a plurality of drain openings for melt water.

7. The apparatus of claim 4, wherein the hopper has opposite side walls which are inclined outwardly from the lower end of the hopper, and opposite end walls, one of the end walls having an outlet opening and the transport chute extending from the outlet opening.

8. The apparatus of claim 7, wherein the opposite side walls of the hopper are inclined at different angles.

9. The apparatus of claim 1, further comprising a film supply feeder in the outer housing which is adapted to feed two superimposed layers of film from the film supply to the bag making and filling station.

10. The apparatus of claim 9, further comprising a film feed sensor which detects when a predetermined length of film has been fed to the bag making and filling station, and a controller associated with the film feed device comprises a film feed control module which receives input from the film feed sensor and is adapted to control the film supply feeder to stop the film supply after each successive bag length of material is fed to the bag making and filling station and to re-start the film supply feeder after each completed bag is separated from the film supply.

11. The apparatus of claim 9, wherein the film supply comprises a roll of film material folded in half along a first longitudinal edge to form the two superimposed layers of film having aligned second longitudinal edges which are separate, and the bag sealing and separating device comprises opposing transverse sealing jaws extending in a direction transverse to the film feed direction and movable between an open position and a closed position to form a transverse seal across the two superimposed layers of film, and opposing longitudinal sealing jaws extending in the film feed direction and movable between an open position and a closed position to form a longitudinal seal along the superimposed second longitudinal edges of the film layers.

12. The apparatus of claim 11, wherein a separating device is associated with the transverse sealing jaws.

13. The apparatus of claim 9, wherein the bag sealing and separating device comprises a pair transverse sealing jaws which form transverse seals at predetermined spaced locations across the two superimposed layers of film and at least one pair of longitudinal sealing jaws which form longitudinal seals along at least one side edge of the two superimposed layers of film, the sealing jaws being movable between an open position spaced from the film material and a closed position engaging opposite faces of the film material, and a bag sealing and separating control module is adapted to control movement of the sealing jaws between open and closed positions and actuation of the sealing jaws to form seals.

14. The apparatus of claim 13, wherein the bag sealing and separating control module is adapted to close and actuate the sealing jaws to create a partially formed bag having a first transverse seal at its lower end, to open the sealing jaws while a bag length of material is fed through the transverse sealing jaws so that the partially formed bag is suspended in a bag fill zone below the sealing jaws, to re-close the sealing jaws to form a transverse seal across the film layers when a predetermined amount of ice has been supplied to the partially formed bag, and to actuate a bag separating device to separate the sealed bag from the subsequent partially formed bag along a separation line which intersects the transverse seal so as to form a second transverse seal at an upper end of the bag and a first transverse seal across a lower end of a subsequent partially formed bag, and to re-open the sealing jaws when the sealed bag is separated from the remainder of the film to allow the next bag length of material to be fed through the sealing jaws.

15. The apparatus of claim 1, wherein the bag sealing and separating device comprises a bag sealing device adapted to form longitudinal and transverse seal lines in the superimposed layers of film at the bag making and filling station and a bag separating device which is adapted to separate a completed bag from the remainder of the film supplied to the bag making and filling station.

16. The apparatus of claim 15, further comprising a controller having a bag sealing and separating control module which controls the bag sealing device to partially form a bag prior to supplying ice to the bag and which controls the bag sealing and separating devices to complete and seal a partially formed bag containing ice and to separate the sealed bag for dispensing into the freezer compartment.

17. The apparatus of claim 16, wherein the controller further comprises a bag transport and distribution control module which is adapted to control release of filled bags of ice into the freezer compartment.

18. The apparatus of claim 17, further comprising a plurality of fill level sensors adapted for mounting in different fill zones in the freezer compartment of the existing aisle freezer, the fill level sensors having outputs communicatively coupled with the bag transport and distribution control module, and a bag transport and distribution station configured for mounting in the freezer compartment between the passageway in the lower end of the outer housing and fill zones in the freezer compartment, the bag transport and distribution station comprising a bag conveyor, a conveyor drive for moving the bag conveyor between a pick up position where bags of ice are received from the bag making station and a series of bag discharge positions where bags of ice are distributed into the respective fill zones of the storage and freezer compartment, and a bag discharge device which is adapted to discharge bags from the conveyor into an aligned bag fill zone, the bag transport and distribution control module being adapted to control the conveyor drive and bag discharge device according to a selected bag distribution sequence based on output signals received from the fill level sensors.

19. The apparatus of claim 18, wherein the bag transport and distribution station further comprises a plurality of conveyor position sensors adapted to detect positioning of the bag conveyor, the conveyor position sensors being communicatively coupled with the bag transport and distribution control module.

20. The apparatus of claim 19, wherein the selected bag distribution sequence comprises discharge of successive bags into a series of successive fill zones of the freezer compartment excluding any fill zones which are filled to a predetermined fill level based on output signals from the associated fill level sensors.

21. The apparatus of claim 1, further comprising a controller which controls operation of the ice making unit and the bag making and filling station, the bag making and filling station having a bag fill measurement device associated with the controller which measures the amount of ice supplied into a bag as it is being formed at the bag making and filling station, and the controller is configured to control the bag sealing and separating device to complete and seal a bag and to separate the sealed bag for dispensing into a freezer compartment when a predetermined amount of ice is detected by the bag fill measurement device.

22. The apparatus of claim 21, wherein the outer housing includes a frame having a bag holder adapted to suspend a partially formed bag during supply of ice to the partially formed bag, the bag fill measurement device comprising at least one weight sensor on the bag holder which measures the weight of the bag and ice.

23. The apparatus of claim 21, wherein the bag fill measurement device comprises a weight measurement device which measures the weight of a partially formed bag at the bag making and filling station while ice is supplied to the bag.

24. The apparatus of claim 1, further comprising a bag transport and distributing station suspended below the lower wall of the outer housing and adapted for location in the freezer compartment when the ice making unit is retrofitted on top of the existing freezer.

25. The apparatus of claim 24, wherein the bag transport and distributing station has a conveyor device which is adapted to receive sealed bags from the bag making and filling station in a pick up area and to convey bags to selected storage areas in a bag storage portion of the freezer compartment.

26. The apparatus of claim 25, further comprising a plurality of fill level sensors associated with the controller and adapted for securing on one or more walls of the freezer compartment, and the controller further comprising a bag discharge control module which controls the conveyor device to convey bags to selected storage areas of the freezer compartment based on the fill levels detected by the fill level sensors, whereby bags are discharged to less full areas of the freezer compartment.

27. The apparatus of claim 26, wherein the bag discharge control module is adapted to suspend discharge of bags into the freezer compartment when all storage areas are full, and to re-start discharge of bags into the storage areas when the fill level falls below a predetermined level.

28. A method of retrofitting an existing aisle freezer with an ice making and bagging apparatus and supplying ice in bags to the existing aisle freezer, comprising:

removing at least part of an upper wall of a freezer compartment of the existing aisle freezer to provide an opening communicating with the freezer compartment;

securing an ice making and bagging apparatus on top of the upper wall of the freezer compartment so that an ice bagging and filling station in the ice making and bagging apparatus is located above the freezer compartment;

mounting at least one fill level sensor at a predetermined height in the freezer compartment, the fill level sensor having an output which communicates with a controller in the ice making and bagging apparatus; and supplying ice in bags from the ice making and bagging apparatus into the freezer compartment.

29. The method of claim 28, wherein the step of supplying ice in bags into the freezer compartment comprises supplying ice from an ice making station in the ice making and bagging apparatus into a partially formed bag at a bag forming station in the ice making and bagging apparatus, sealing the bag, discharging the sealed bag through the opening into the freezer compartment, and repeating the preceding bagged ice supplying steps until the freezer compartment is filled to a predetermined level with bags of ice.

30. The method of claim 29, further comprising detecting the fill level of ice bags in the freezer compartment with the fill level sensor, providing the fill level output to a controller in the ice making and bagging apparatus, suspending supply of ice in bags when the compartment is sufficiently full, and re-starting the steps of making bags filling them with ice, and supplying ice in bags to the freezer compartment when ice bag level in the freezer compartment falls below a selected level.

31. The method of claim 30, further comprising securing at least two level sensors in the freezer compartment to detect fill level in at least two different areas of the freezer compartment, the step of detecting the fill level comprising monitoring fill level in the at least two different areas of the freezer compartment and communicating the fill levels to the controller, and the step of discharging sealed bags into the freezer compartment comprises discharging bags into the at least two different areas in a predetermined sequence based on the detected fill level in the respective areas.

32. The method of claim 29, wherein the step of supplying ice from an ice making station in the ice making and bagging apparatus into a partially formed bag at a bag forming station in the ice making and bagging apparatus comprises collecting ice formed at the ice making station in an ice collector and transporting ice from the ice collector to the bag forming station.

33. The method of claim 32, wherein the step of supplying ice to an ice collector further comprises supplying ice sequentially to first and second ice collectors, transporting ice from the first ice collector into a partially formed bag, and transporting ice from the second ice collector to the first ice collector for transport into a partially formed bag.

34. The method of claim 32, further comprising draining melt water from the ice as it is transported from the ice collector to a partially formed bag at the bag forming station.

35. The method of claim 29, further comprising suspending the partially formed bag at least partially into the freezer compartment as ice is supplied to the bag.

36. The method of claim 29, further comprising stopping supply of ice to the partially formed bag after a predetermined amount of ice is supplied to the bag.

37. The method of claim 36, further comprising supplying bag forming film material from a film supply to the bag forming station, supporting the partially formed bag on a support device after ice transport to the bag is stopped until the bag is sealed and separated from the remainder of film supply.

38. The method of claim 37, further comprising releasing the separated bag from the support device into the freezer compartment after sealing and separation is complete.

39. The method of claim 37, further comprising driving the support device to a selected position above a selected area in the freezer compartment after a bag is sealed and separated, before releasing the bag from the support device.

40. The method of claim 39, further comprising driving the support device back to a bag pick up position after the bag is discharged from the device, picking up a second bag on the support device, driving the support device to a selected different position above a different area of the freezer compartment, and discharging the second bag from the support device so that it falls into the different area of the freezer compartment.

41. The method of claim 28, further comprising partially forming a bag at a bag forming station before supplying ice to the partially formed bag, the step of partially forming a bag comprising forming longitudinal seal along at least one open side edge of two superimposed layers of bag-making film and forming a transverse lower end seal across a lower end of superimposed layers to produce a partially formed bag.

42. The method of claim 41, further comprising supplying a first bag length of bag-making film in two superimposed layers to the bag forming station before forming the longitudinal seal and lower end seal, and subsequently supplying a second bag length of bag-making film to the bag forming station while simultaneously feeding the first, partially formed bag into a bag fill zone.

43. The method of claim 42, wherein the step of sealing the bag comprises forming a transverse seal which simultaneously seals an upper end of a first bag and a lower end of a second bag.

44. The method of claim 43, wherein the longitudinal seal and the transverse lower end seal are formed in separate sealing steps.

45. The method of claim 43, wherein the longitudinal seal of the second bag is formed before ice is supplied to the first bag.

46. The method of claim 43, further comprising separating the first bag from the second bag length along a line of separation through the transverse seal before discharging the first bag into the freezer compartment.

47. The method of claim 28, further comprising positioning a bag transport and discharge device in the freezer compartment above a bag storage and dispensing area in the freezer compartment, whereby a bag receiving area of the bag transport and discharge device is located below the opening.

48. The method of claim 47, wherein the step of supplying a bag of ice into the freezer compartment comprises receiving a sealed bag onto a conveyer of the bag transport and discharge device, selecting a fill zone in the freezer compartment from at least two fill zones, displacing the conveyor and sealed bag to a selected position based on the selected fill zone, and discharging the bag from the conveyor into the selected fill zone.

49. The method of claim 48, further comprising mounting a plurality of fill level sensors in multiple different fill zones of the freezer compartment to detect fill levels in the respective fill zones, the controller monitoring the outputs of the fill level sensors to determine fill level in the multiple different fill zones of the freezer compartment, comparing the degree of filling in the different fill zones at the controller, and selecting a fill zone for discharge of bags on the basis of said comparison.

* * * * *

UNITED STATES PATENT AND TRADEMARK OFFICE

CERTIFICATE OF CORRECTION

PATENT NO. : 8,800,305 B2
APPLICATION NO. : 12/847898
DATED : August 12, 2014
INVENTOR(S) : Henrik Pape and Ken Strong It is certified that error appears in the above-identified patent and that said Letters Patent is hereby corrected as shown below:

On the Title page of the patent in Item (63) the Related U.S. Application Data section, after "filed as application No. PCT/DK2008/000027 on" replace "Jul. 24, 2009" with --Jan. 24, 2008--.

In the Specification

Column 1, line 12, between the phrases "132 filed on" and "and entitled Method and Apparatus", replace "Jul. 24, 2009" with --Aug. 28, 2009--.

Figure 27:
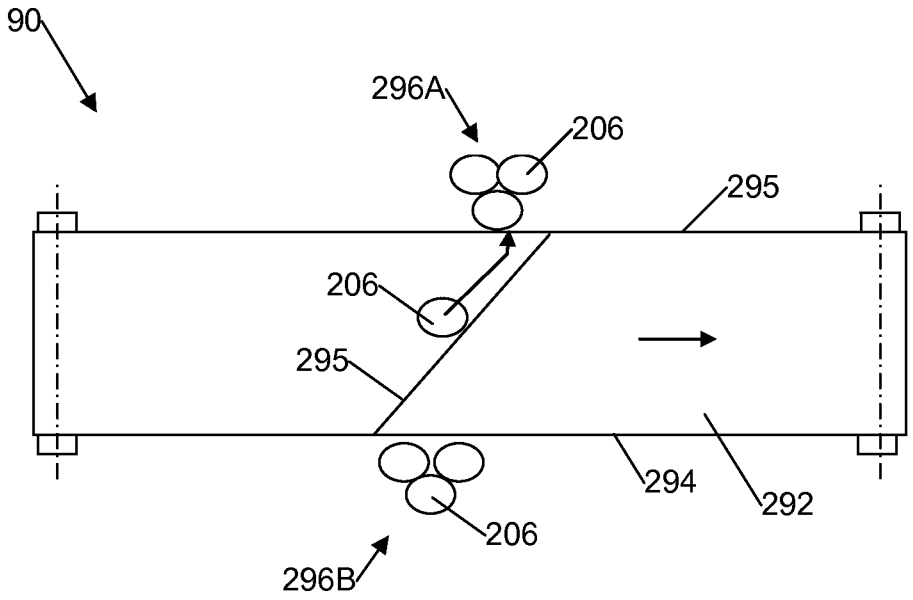

Column 20, line 4, before the phrase "illustrates an alternative embodiment of a convey-", replace "FIG. 26" with --FIG. 27--.

Signed and Sealed this
Seventeenth Day of March, 2015

Michelle K. Lee

Michelle K. Lee
*Director of the United States Patent and Trademark Office*